US012702220B2

(12) United States Patent
Weber et al.

(10) Patent No.: US 12,702,220 B2
(45) Date of Patent: Aug. 11, 2026

(54) SELF-DISPENSING LOW VOLUME APPLICATOR

(71) Applicant: Alexander Weber, Houston, TX (US)

(72) Inventors: Alexander Weber, Houston, TX (US); Mark Farid, Belmont, CA (US); Boris Bass, Spring, TX (US)

(73) Assignee: Alexander Weber, Houston, TX (US)

( * ) Notice: Subject to any disclaimer, the term of this patent is extended or adjusted under 35 U.S.C. 154(b) by 758 days.

(21) Appl. No.: 17/938,281

(22) Filed: Oct. 5, 2022

(65) Prior Publication Data

US 2023/0107738 A1 Apr. 6, 2023

Related U.S. Application Data

(60) Provisional application No. 63/262,096, filed on Oct. 5, 2021.

(51) Int. Cl.
*A46B 11/00* (2006.01)
*A45D 24/22* (2006.01)

(52) U.S. Cl.
CPC ..... *A46B 11/0006* (2013.01); *A45D 24/22* (2013.01); *A46B 11/001* (2013.01); *A46B 2200/104* (2013.01)

(58) Field of Classification Search
CPC ..... A46B 11/0006; A46B 11/001; A46B 2200/104; A46B 11/0013; A46B 11/0062;
(Continued)

(56) References Cited

U.S. PATENT DOCUMENTS 3,256,894 A 6/1966 Sherman
3,463,170 A * 8/1969 Mccullough ..... A45D 24/26 401/176

(Continued)

FOREIGN PATENT DOCUMENTS

CN 2255180 6/1997
CN 111150207 A * 5/2020 ..... A61H 11/00

(Continued)

OTHER PUBLICATIONS

Luo, A Hair-strengthening comb, 2020, Espacenet Translation (Year: 2020).*

(Continued)

*Primary Examiner* — Rebecca E Eisenberg
*Assistant Examiner* — Brandon W. Levy
(74) *Attorney, Agent, or Firm* — Thompson Patent Law Offices PC

(57) ABSTRACT

Apparatus and associated methods relate to a fluid dispensing device that includes a dispensing bristle for selectively dispensing fluid onto an application surface. In an illustrative example, the fluid dispensing device may include a tapered cylindrical valve for flow control. For example, upon applying a predetermined pressure, the tapered cylindrical valve may be opened, allowing the fluid dispensing device to dispense a small amount of fluid (e.g., medicine, soap, shampoo, coconut oil, plant extract combinations) onto an application surface. Various embodiments may advantageously allow a user to dispense a selective amount of the medicine to the scalp.

10 Claims, 20 Drawing Sheets

(58) Field of Classification Search
CPC ..... A46B 11/0089; A46B 11/0041; A46B 11/0055; A45D 24/22; A45D 24/26; A45D 19/0083; A01K 13/003; A01K 13/002; A61M 35/003
See application file for complete search history.

(56) References Cited

U.S. PATENT DOCUMENTS

| | | | | |
|---|---|---|---|---|
| 3,961,635 | A | 6/1976 | Miya | |
| 4,211,247 | A | 7/1980 | Morganroth | |
| 4,430,013 | A * | 2/1984 | Kaufman | A61M 35/003 401/133 |
| 4,543,913 | A | 10/1985 | Wilkeson | |
| 4,585,018 | A | 4/1986 | O'Connor | |
| 4,617,875 | A * | 10/1986 | Holland | A01K 13/003 401/281 |
| 4,799,456 | A | 1/1989 | Young | |
| 5,169,251 | A | 12/1992 | Davis | |
| 5,183,006 | A | 2/1993 | Robinson | |
| 5,803,093 | A | 9/1998 | Romano | |
| 5,975,089 | A | 11/1999 | Simon | |
| 6,035,806 | A | 3/2000 | Lorenzo | |
| 6,109,214 | A | 8/2000 | Rampersad | |
| 6,187,815 | B1 | 2/2001 | Hallam et al. | |
| 6,378,529 | B1 | 4/2002 | Marco | |
| 6,457,476 | B1 | 10/2002 | Elmer et al. | |
| 8,087,843 | B2 | 1/2012 | Ottaviani et al. | |
| 2004/0097890 | A1 | 5/2004 | Wilkinson | |
| 2007/0068544 | A1 | 3/2007 | Hackl et al. | |
| 2007/0261643 | A1 | 11/2007 | Hurwitz | |
| 2016/0089526 | A1 * | 3/2016 | Hofland | B05B 11/0038 604/311 |
| 2019/0261768 | A1 * | 8/2019 | Tsui | A01K 13/001 |

FOREIGN PATENT DOCUMENTS

| | | | |
|---|---|---|---|
| GB | 2569033 | A | 6/2019 |
| WO | 2018064688 | A1 | 4/2018 |
| WO | 2018175523 | A1 | 9/2018 |

OTHER PUBLICATIONS

Big Dee's Tack & Vet Supplies, Partrade Oval Rubber Curry Comb with Handle, retrieved from the internet, <https://www.bigdweb.com/product/oval+rubber+curry+comb+with+handle.do?from=ac>.

Hairmax, Hairmax Laser Comb For Hair Growth (FDA Cleared), ULTIMA 12 Classic, Laser Hair Growth Treatment for Men & Women, Thinning Hair Treatment for Women and Men, Denser and Fuller Hair, Spot or Full Scalp, Hair Growth Products to Reverse Thinning Hair, 100% Medical Grade Laser Light—Unlike Red Light Therapy, Amazon.com, retrieved from the internet, <https://www.amazon.com/HairMax-Cleared-Treatment-Thinning-Reverse/dp/B015PXY0LG>.

SmartPak, Rubber Curry Comb, SmartPak Equine, retrieved from the internet, <https://www.smartpakequine.com/pt/rubber-curry-comb-5215>.

* cited by examiner

SELF-DISPENSING LOW VOLUME APPLICATOR

CROSS-REFERENCE TO RELATED APPLICATIONS

This application claims the benefit of U.S. Provisional Application Ser. No. 63/262,096, titled Self-Dispensing Low Volume Applicator," filed by Alexander Weber, et al., on Oct. 5, 2021.

This application incorporates the entire contents of the foregoing application(s) herein by reference.

The subject matter of this application may have common inventorship with and/or may be related to the subject matter of U.S. Design Application Ser. No. 29/696,167, titled "Low Volume Solution Applicator," filed by Alexander Weber, et al., on Jun. 25, 2019.

This application incorporates the entire contents of the foregoing application(s) herein by reference.

TECHNICAL FIELD

Various embodiments relate generally to fluid dispensing devices.

BACKGROUND

Fluid dispensing equipment generally refers to devices that dispenses fluid media. Various dispensing equipment can have functions including, for example, mixing, metering, or some combination thereof before dispensing the fluid media. Some examples of fluid dispensing equipment include syringes for dispensing solution, a handheld gun for dispensing caulk to seal joints, and a sanitation station for dispensing cleaning detergents. Some dispensing equipment may include a microprocessor and/or robotic machine to precisely dispense media in an accurate repetitive amount. Some other dispensing equipment may be handheld for dispensing smaller quantities of fluid.

A dropper, also known as a Pasteur pipette, is a device used to dispense small quantities of liquids. They are widely used in daily lives and laboratories to dispense small amounts of liquid. For example, people may use a dropper to dispense eye drops into the eye. One common example of a dropper is a pipette tapered to a narrow point and fitted with a rubber bulb at the top. The combination of the pipette and rubber bulb has also been referred to as a teat pipette. The eye dropper, both glass and plastic types, can be sterilized and plugged with a rubber bulb at the open end of the pipette preventing any contamination from the atmosphere.

SUMMARY

Apparatus and associated methods relate to a fluid dispensing device that includes a dispensing bristle for selectively dispensing fluid onto an application surface. In an illustrative example, the fluid dispensing device may include a tapered cylindrical valve for flow control. For example, upon applying a predetermined pressure, the tapered cylindrical valve may be opened, allowing the fluid dispensing device to dispense a small amount of fluid (e.g., medicine, soap, shampoo, coconut oil, plant extract combinations) onto an application surface. Various embodiments may advantageously allow a user to dispense a selective amount of the medicine to the scalp.

Various embodiments may achieve one or more advantages. In some embodiments, for example, bellowed gussets in registration with the dispensing bristles may advantageously provide flexibility for movement of the dispensing bristles. In some embodiments tapered bristles may, for example, advantageously penetrate the hair on the scalp. In some examples, tapered bristles may advantageously reduce medicine being needlessly applied to the hair. In some embodiments, a vent in the fluid dispensing device may, for example, advantageously allow balancing of pressure between outside and inside of the fluid dispensing device by allowing gas to flow through. In some examples, a selective barrier provided for the vent may, for example, advantageously prevent liquid from flowing through while maintaining the vent permeable to gases.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary self-dispensing low volume applicator with reference to FIGS. 1-7. Second, with reference to FIGS. 8-11, this document describes another exemplary self-dispensing low volume applicator. Third, that introduction leads into a description with reference to FIGS. 12-15 of another exemplary self-dispensing low volume applicator. Fourth, with reference to FIGS. 16-17, a version of a dispensing applicator with a handle is discussed. Fifth, turning to FIG. 18, an illustrative valvular conduit vent for a dispensing applicator is disclosed.

Figure 1A:
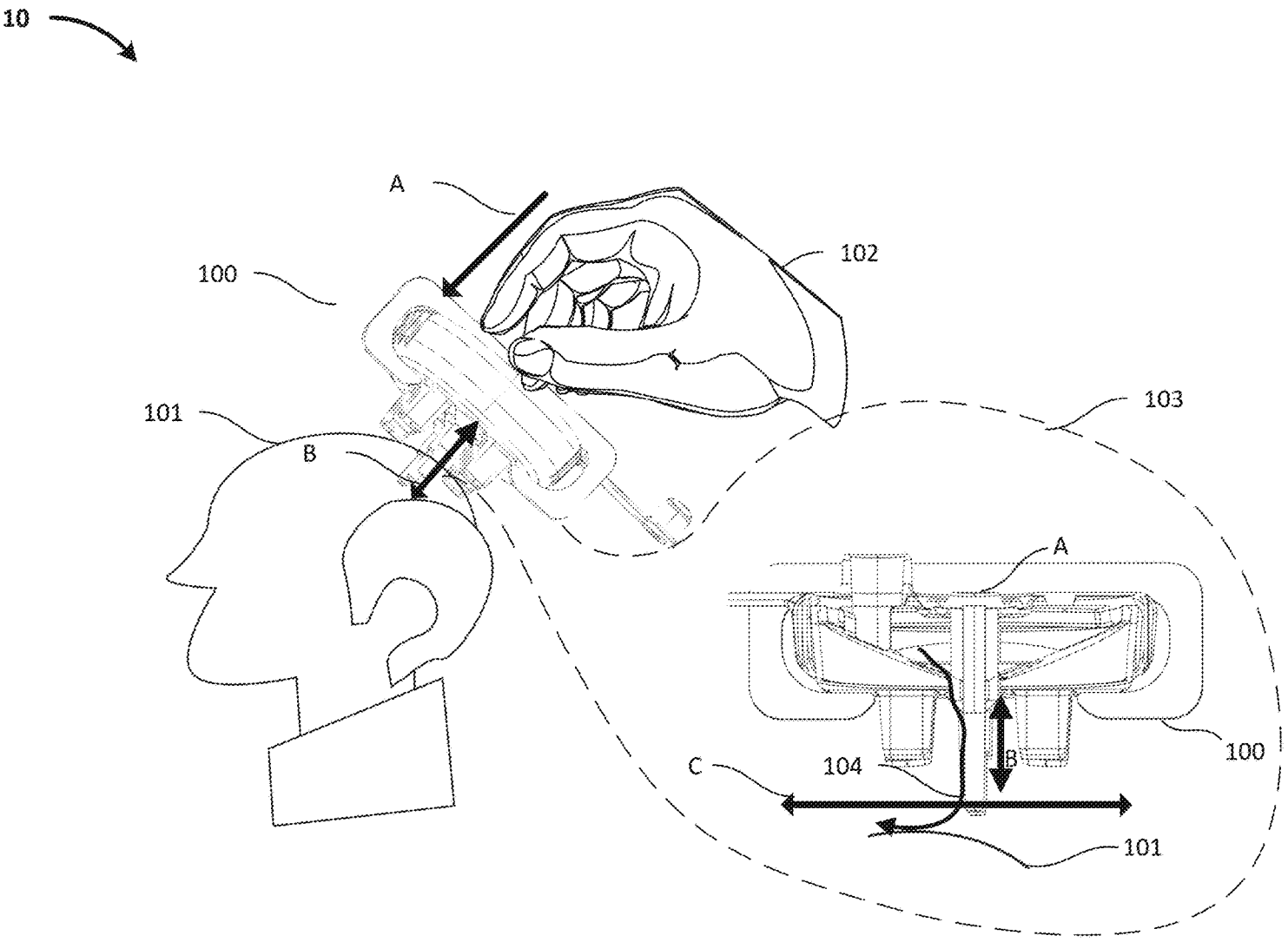
FIG. 1A illustrates an exemplary use-case scenario of an exemplary dispensing applicator.

FIG. 1A illustrates an exemplary use-case scenario 10 of an exemplary dispensing applicator. In the exemplary use-case scenario 10, an exemplary dispensing applicator 100 is used to dispense fluid on a head 101 of a user. The dispensing applicator 100 is moved by a hand 102 of the user. The hand 102 applies a motion downwards A to the dispensing applicator 100. In reaction to the motion downwards A, inner stopper (e.g., dispensing) bristles may, as depicted, respond by moving upward in a motion B within outer hollow (e.g., fluid communication channel) bristles. Accordingly, the motion B (e.g., in response to the motion A, such as applying a minimum force to the dispensing applicator 100) may advantageously transition the dispensing bristles and fluid communication channels from a stand-by state (e.g., sealed) to a dispensing state (e.g., un-sealed).

The dispensing applicator 100 contains a fluid 104. In response to the motion B of the dispensing bristles, the fluid 104 is dispensed from a cavity of the dispensing applicator 100 through the fluid communication channels.

In an exploded view 103, the motion downwards A is shown applied to the dispensing applicator 100. The fluid 104 is shown to be distributed when the brushes of the dispensing applicator 100 are moved in a side-to-side motion C. The fluids 104 are dispersed on to the head 101.

Figure 1B:
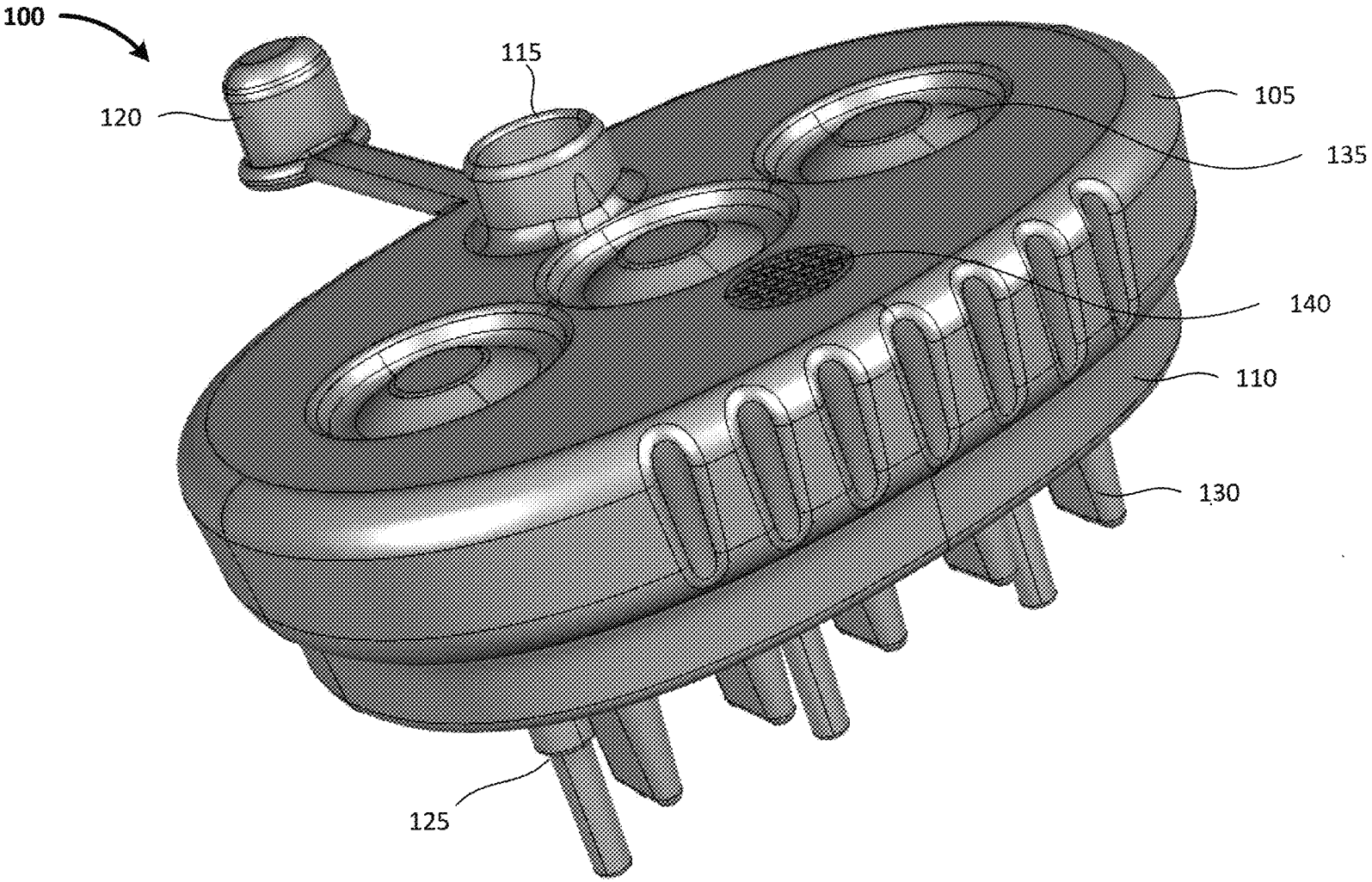
FIG. 1B depicts an exemplary dispensing applicator configured to selectively dispense liquid in low volume.

FIG. 1B depicts the exemplary dispensing applicator 100 configured to selectively dispense liquid in low volume. The dispensing applicator 100 includes a first housing 105 and a second housing 110. The first housing 105 and the second housing 110, as depicted, are coupled together to define an internal cavity. For example, liquid may be deposited into the internal cavity by a port 115. The port 115 may be closed by a cap 120, for example, to avoid liquid being spilt out of the internal cavity during use.

The second housing 110 includes at least one dispensing bristle 125 and at least one tapered bristle 130. In some implementations, the dispensing bristle 125 and the tapered bristle 130 may rest against an application surface (e.g., a body portion) for dispensing liquid stored in the cavity of the dispensing applicator 100. In some examples, the liquid may be dispensed from the cavity through at least one dispensing bristle 125 in a controlled volume and/or flow rate.

In some embodiments the tapered bristle(s) 130 may, for example, be configured to distribute fluid dispensed from the internal cavity through the dispensing bristle(s) 125. In the depicted example the tapered bristle 130 is wider and tilted slightly towards the center dispensing bristle such that, stroking motions of the dispensing applicator 100 on an application surface may 'spread' the fluid out from a dispensed location in at least two directions.

In some embodiments, the tapered bristle 130 may be positioned to reduce or eliminate the liquid being dispended on undesired recipients rested on the application surface. For example, the undesired recipients may be some filaments or other loose objects deposited or otherwise present on the application surface. For example, the application surface may include a scalp and the undesired recipients may be the hair. The tapered bristles 130 may, in some implementations, advantageously allow the dispensing applicator 100 to substantially reduce liquid being dispensed on the hair.

In the various embodiments, the dispensing applicator 100 may include a fluid communication channel connecting to the cavity for selectively dispensing fluid onto the application surface. For example, in a stand-by state, the fluid communication channel may be sealed to prevent fluid from flowing out. For example, in a dispensing state, the channel may allow selectively controlled flow based on a level of force by which the dispensing applicator 100 is pressed against the application surface. The dispensing bristles may deform in response to the level of force applied.

In the depicted example, the first housing 105 of the dispensing applicator 100 includes three gussets 135. In the depicted example, the gusset 135 is formed with a folded bellow. In some implementations, the gussets 135 may advantageously reduce pressure of the first housing 105 and/or allow displacement of the dispensing bristle 125 in a dispensing mode.

The first housing 105 includes a vent 140. By way of example and not limitation, the vent may include a one-way valve, such as a tesla valve. In the dispensing mode, the vent 140 may substantially balance air pressure between the internal cavity and outside environment. In some implementations, the vent 140 may advantageously facilitate the fluid communication of the liquid from the cavity to the application surface. For example, the vent 140 may advantageously reduce or eliminate development of a sub-zero pressure (e.g., vacuum) in the cavity during dispensing of fluid. Accordingly, the flow of the fluid may be advantageously controlled by selective operation of the bristles without (substantial) interference in the flow from development of a suction.

Figure 2:
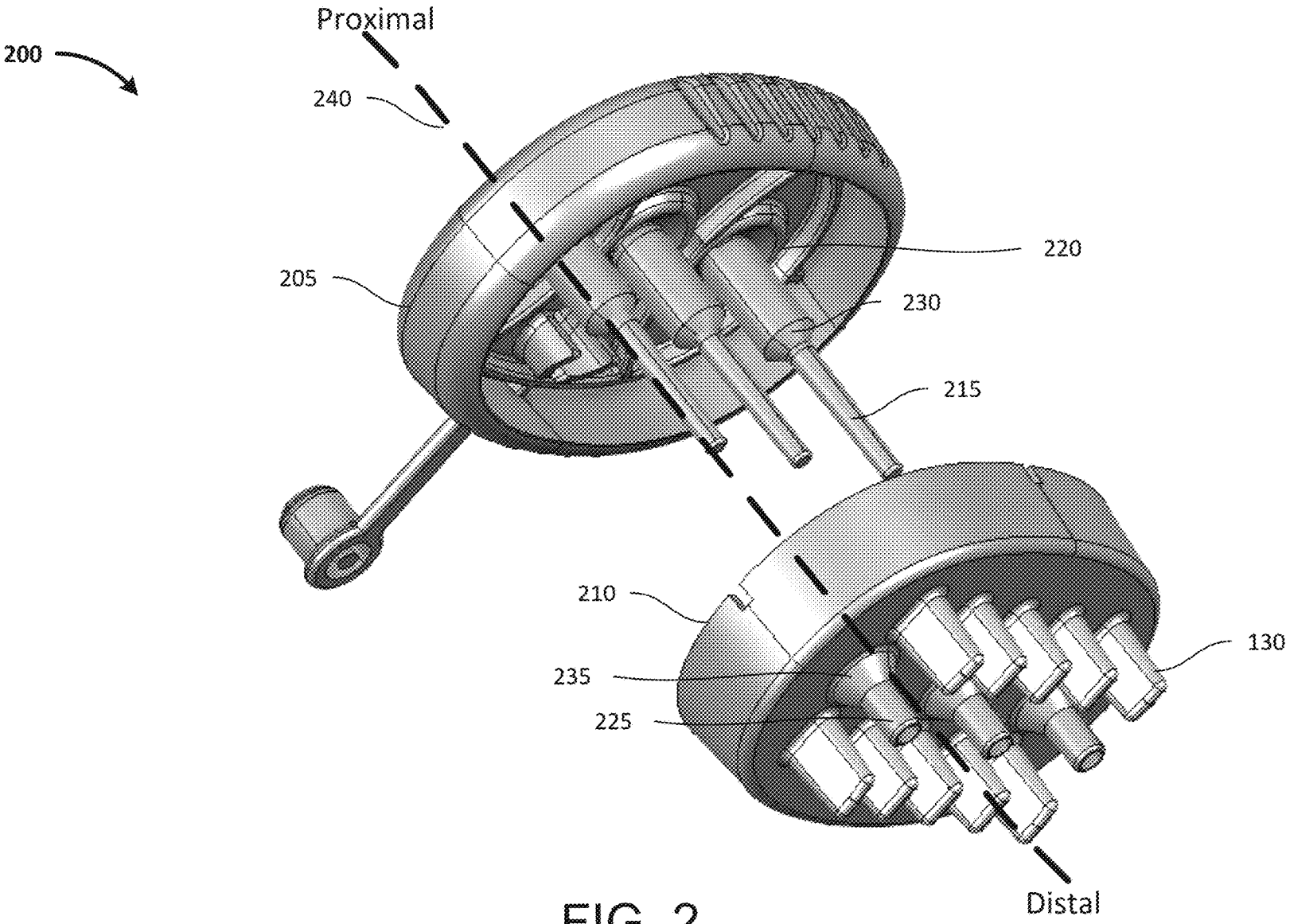
FIG. 2 shows an exploded view of an exemplary dispensing applicator.

FIG. 2 shows an exploded view of an exemplary dispensing applicator 200. The dispensing applicator 200 may, in some implementations, be the dispensing applicator 100 as described in FIG. 1A. In the depicted example, the dispensing applicator 200 includes a first housing 205 and a second housing 210. For example, the first housing 205 and the second housing 210 may be coupled together to define an internal cavity.

The first housing 205 includes one or more dispensing bristles 215 that are each coupled to the first housing 205 by one or more gussets 220. In some examples, the dispensing bristles 215 may move along a longitudinal axis 240 as shown in the figure. For example, the longitudinal axis 240 may be substantially perpendicular to the gussets 220. The gussets 220 may, for example, include one or more bellows. In some implementations, the gussets 220 may advantageously allow movement of the dispensing bristle along the longitudinal axis 240.

The second housing 210 includes one or more fluid communication channels 225 for dispensing fluid from the internal cavity. In some implementations, the dispensing bristle 215 may be deposited in substantial coaxial alignment within the fluid communication channel 225. For example, the dispensing bristle 215 may be operated to selectively occlude the fluid communication channel 225.

In some implementations, the dispensing bristle 215 may be operated to control the flow of fluid from the internal cavity through the fluid communication channels 225. In this example, the dispensing bristle 215 includes a first taper 230 and the fluid communication channel 225 includes a second taper 235. In some implementations, the first taper 230 may sealingly engage the second taper 235 when brought into register (e.g., coaxially aligned) and urged together. The first taper 230 and the second taper 235 may, for example, sealingly engage when urged together by a (predetermined) force along the longitudinal axis 240.

In some implementations, the fluid communication channel 225 may remain closed when a force is applied to the dispensing applicator 200 less than the predetermined force, along the longitudinal axis 240, from the distal end to the proximal end. For example, the first taper 230 and the second taper 235 may remain urged together (e.g., by the corresponding gusset 220) to substantially seal the fluid communication channel 225 from fluid communication with the internal cavity. In some implementations, the fluid communication channel 225 may be opened when a force greater than the predetermined force is applied to the dispensing applicator 200 from the distal end to the proximal end. For example, the first taper 230 may be forced proximally from (away from) the second taper 235 along the longitudinal axis 240. In some examples, the fluid communication channel 225 may thereby be unsealed to facilitate fluid flowing out of the internal cavity.

In some implementations, various lengths of the dispensing bristle 215 may be used to selectively control the flow rate of the fluid. For example, a longer dispensing bristle 215 may allow a greater force to be applied to urge the first taper 230 further away from the second taper 235. In some examples, the greater distance between the first taper 230 and the second taper 235 may allow a higher rate of the fluid to flow out of the internal cavity. In some implementations, the gussets 220 may absorb the distance displaced between the first taper 230 and the second taper 235. For example, a greater proximal displacement of the dispensing bristle 215 may align a portion of the dispensing bristle 215 with a smaller cross-sectional area within the fluid communication channel 225 such that a resulting annular lumen increases in cross-sectional area.

In some embodiments, the gusset 220 may urge the dispensing bristle 215 to close the fluid communication channel 225. For example, the gusset 220 may return the first taper 230 towards the second taper 235 when the force applied along the longitudinal axis 240 is less than the predetermined force. In various embodiments, the dispensing applicator 200 may advantageously be self-closing when the force applied along the longitudinal axis 240 is less than the predetermined force.

Figure 3A:
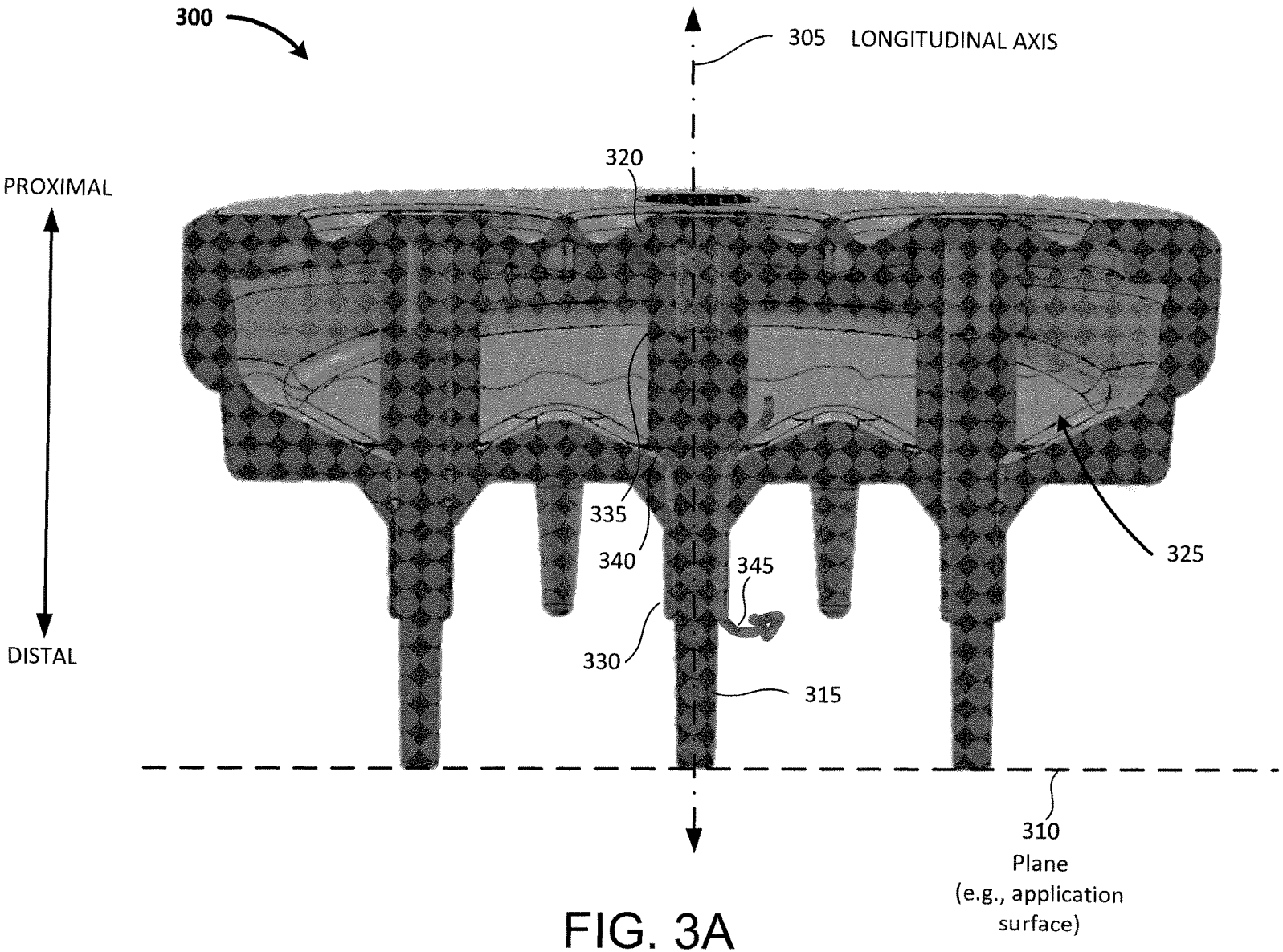
FIG. 3A shows an exemplary cross-section view to illustrate an exemplary dispensing applicator.

FIG. 3A shows an exemplary cross-section view to illustrate an exemplary dispensing applicator 300. In this example, the dispensing applicator 300 is aligned along the longitudinal axis 305 and resting on a plane 310. For example, the plane 310 may be the scalp of a head.

The dispensing applicator 300 includes a dispensing bristle 315 and a gusset 320. In some examples, the bristle 315 may be connected to the gusset 320. As shown in the depicted example, the dispensing applicator 300 includes fluid 325 within an internal cavity. In the depicted example, the dispensing bristle 315 is in substantially registration with a fluid communication channel 330. In this example, the fluid communication channels 330 are sealingly closed, in a stand-by state, from fluid communication with the internal cavity by sealing engagement of a first taper 335 of the dispensing bristle 315 against a second taper 340 of the fluid communication channel 330.

In some implementations, an applied force to the dispensing applicator 300 from the proximal end of the dispensing applicator 300 (e.g., urging the dispensing applicator 300 towards the plane 310) may force a surface defining the plane 310 (e.g., a scalp) to push up the dispensing bristle 315. In some examples, the first taper 335 may be displaced from the second taper 340. As shown in this example, the fluid 325 may thereby flow out of the dispensing applicator 300 as indicated by an arrow 345.

Various embodiments, for example, with a 'plugging' bristle (e.g., closure member, dispensing bristle, tapered bristle) may advantageously selectively seal fluid communication channels of hollow bristles.

Figure 3B:
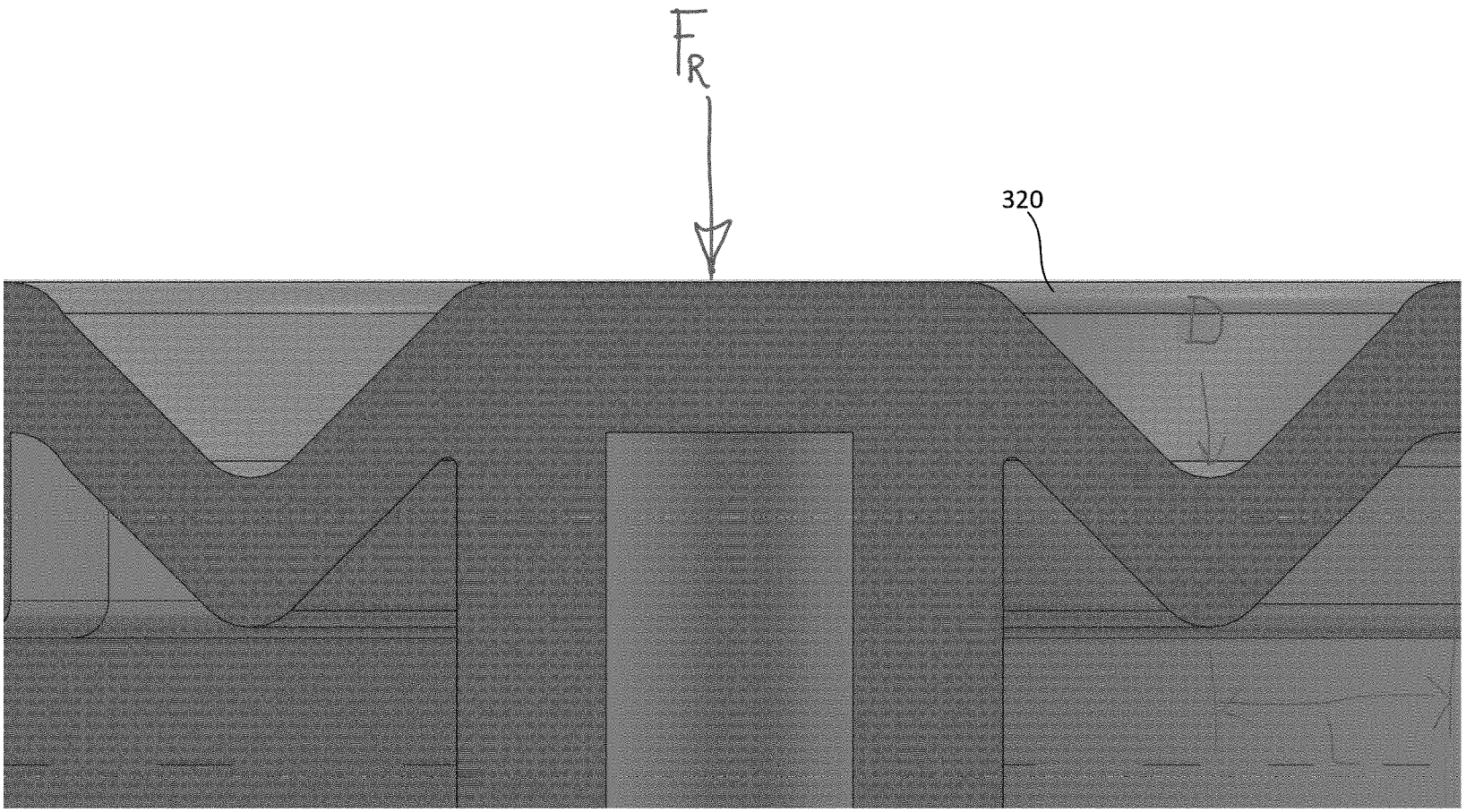
FIG. 3B shows an exemplary cross-section view of a gusset geometry.

FIG. 3B shows an exemplary cross-section view of a gusset geometry. The gusset 320 may, for example, be configured as a bellows. The gusset, as depicted, has at least one fold. In the depicted cross-sectional view, the fold has an inner diameter of curvature, D. The fold has a length to a next fold and/or end point of the gusset, L. In embodiments with multiple (e.g., quantity=N) folds, the ith fold, may have a diameter of curvature $D_i$. The ith fold may have a length $L_i$. $D_i$ may, for example, be defined by a minimum diameter $<D_i<$a maximum diameter. $L_i$ may, for example, be defined by a minimum length $<L_i<$a maximum length. A resistive force $F_R$ of the gusset may be a (predetermined) minimum force required to be applied along the longitudinal axis 305 to induce flexion of the gusset 320. $F_R$ may, by way of example and not limitation, be a function of the diameter D and/or the length L. In some embodiments $F_R$ may, for example, be a function of a number of folds in the gusset 320. $F_R$ may, for example, be a function of a thickness of material being flexed (e.g., a thickness of the gusset 320). In some embodiments, for example, a thinner flexion area may correspond to a decreased $F_R$. In some embodiments, for example, an increased number of folds in a gusset may reduce an amount of material that must be displaced. in some embodiments, for example, a decreased amount of material to be displaced may correspond to a reduction in $F_R$. In some embodiments, for example, an increased number of folds in a gusset may reduce tension on the gusset and so reduce $F_R$.

Figure 4:
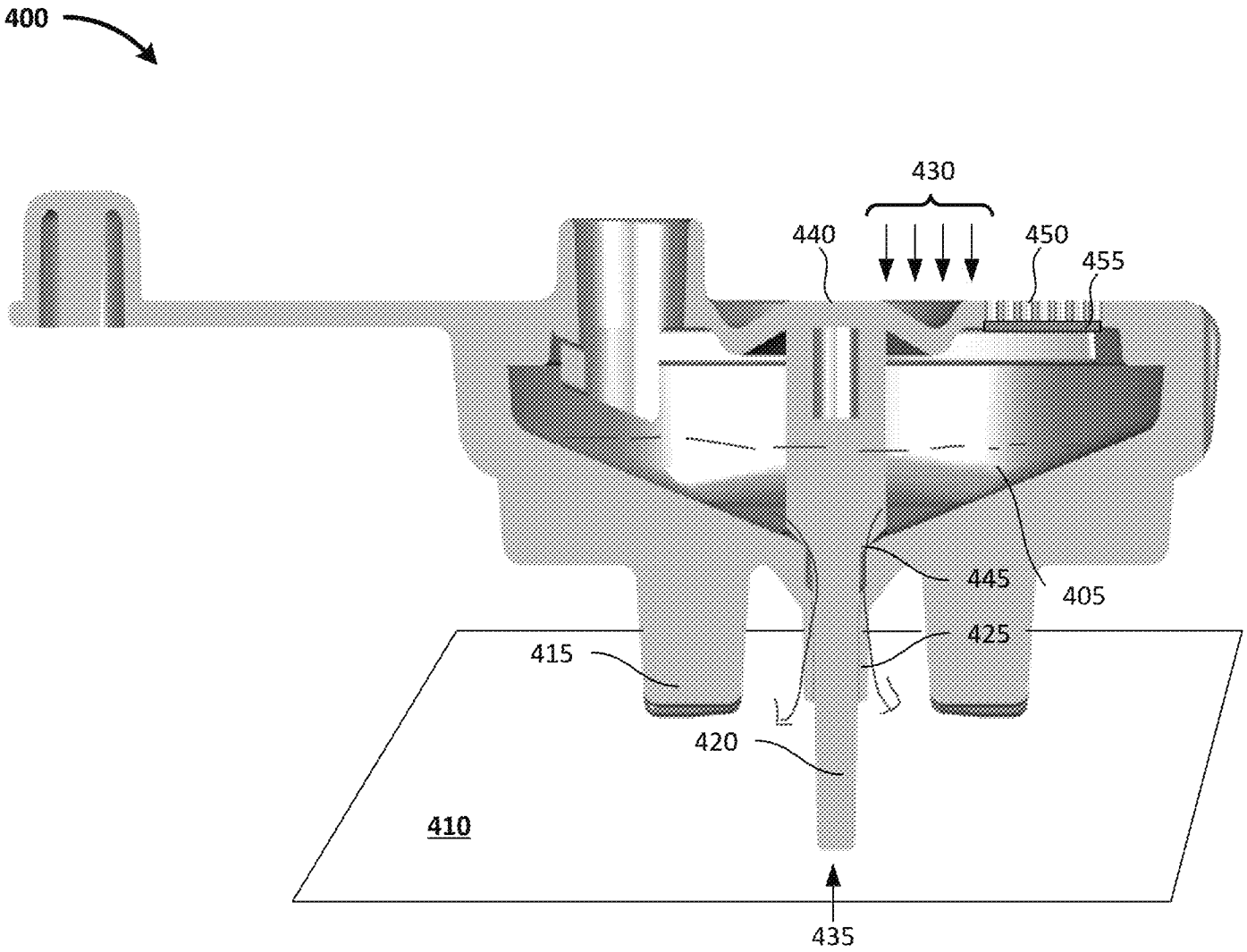
FIG. 4 shows another exemplary cross-section view of an exemplary dispensing applicator.

FIG. 4 shows another exemplary cross-section view of an exemplary dispensing applicator 400. As shown in this example, the dispensing applicator 400 include a fluid 405 and is positioned on an application surface 410. For example, the dispensing applicator may operate to dispense the fluid 405 onto the application surface 410. For example, the application surface 410 may be a scalp.

The dispensing applicator 400 includes one or more tapered bristles 415 and one or more dispensing bristles 420. The dispensing bristle 420 is substantially registered with a fluid communication channel 425. In one example, the dispensing applicator 400 may operate in a stand-by mode and a dispensing mode. For example, in the stand-by mode, the dispensing applicator 400 may rest against the application surface 410 without dispensing the stored fluid 405. For example, in the dispensing mode, the fluid 405 may flow out from the dispensing applicator 400 via the fluid communication channel 425.

In some embodiments, as an illustrative example, an applied force 430 may be applied from the top of the dispensing applicator 400 towards the application surface 410 in the dispensing mode. For example, the applied force 430 may trigger a reaction force 435 from the application surface 410 on the dispensing bristles 420. For example, the dispensing bristles 420 may be pushed upwards as indicated by the arrow of the force 435.

In some implementations, the dispensing applicator 400 may return to the stand-by mode when the applied force 430, for example, reduces to below a predetermined level. In this example, the dispensing bristle 420 is registered with a gusset 440. The gusset 440, as an example without limitation, may be bellowed to allow flexibility for displacement of the dispensing bristles 420 in the dispensing mode. In some examples, when the dispensing applicator 400 transits from the dispensing mode to the stand-by mode, the gusset 440 may return the dispensing bristle 420 to a seal position.

At the seal position, in this example, the dispensing bristles 420 includes a seal 445. In various embodiments, the seal 445 may be substantially coaxially deposited at an aperture of the fluid communication channel 425. In some implementations, the seal 445 may be tapered to substantially register with a tapering shape of the aperture of the fluid communication channel 425. For example, the seal 445 may be adhesively engaged with the fluid communication channel 425 in the stand-by mode. For example, the seal 445 may prevent fluid from flowing out of the fluid communication channel 425 in the stand-by mode.

In this example, the dispensing applicator 400 includes a vent 450. For example, the vent 450 may reduce pressure created by a change in the volume inside a cavity of the dispensing applicator 400. In this example, a film 455 is deposited on an underside of the vent 450. In other examples, the film 455 may be deposited on a topside of the vent 450. In some embodiments, the film may include a PTFE film. In some examples, the film 455 may prevent the fluid 405 from flowing out of the vent 450. In some embodiments, the film 455 may be a treated PTFE film that may substantially prevent ethanol from penetrating. For example, the film 455 may be configured as a gas permeable, liquid resistant (e.g., impermeable) filter barrier. The film may, for example, be configured with a predetermined (maximum) pore size to resist penetration of at least some liquids (e.g., water, ethanol). The film may, for example, be configured with a predetermined pore size to allow penetration of at least some gases (e.g., air). In some embodiments the film may, for example, be configured to resist degradation by target chemicals. The target chemicals may, for example, be (components of) solutions which the dispenser may be configured to dispense.

In various implementations, the dispensing applicator 400 may advantageously control dosage of the fluid 405. For example, a user may control the applied force 430 to control the dosage of the fluid 405. In some examples, the user may control to distribute a preferred amount of the fluid 405 by observing or otherwise sensing the dispensing of the fluid 405 on the application surface 410. In some implementations, the dispensing applicator 400 may be self-sealing in the stand-by mode. For example, after a usage of the fluid 405, any remaining fluid 405 may be stored in the dispensing applicator 400 for future use.

In some embodiments, such as depicted in FIGS. 3A and 4, a floor of the cavity of the dispensing applicator 400 may be sloped into at least one of the fluid communication channels of the hollow bristles. For example, the floor may be sloped into each hollow bristle. Accordingly, fluid wastage may be reduced or eliminated.

Figure 5:
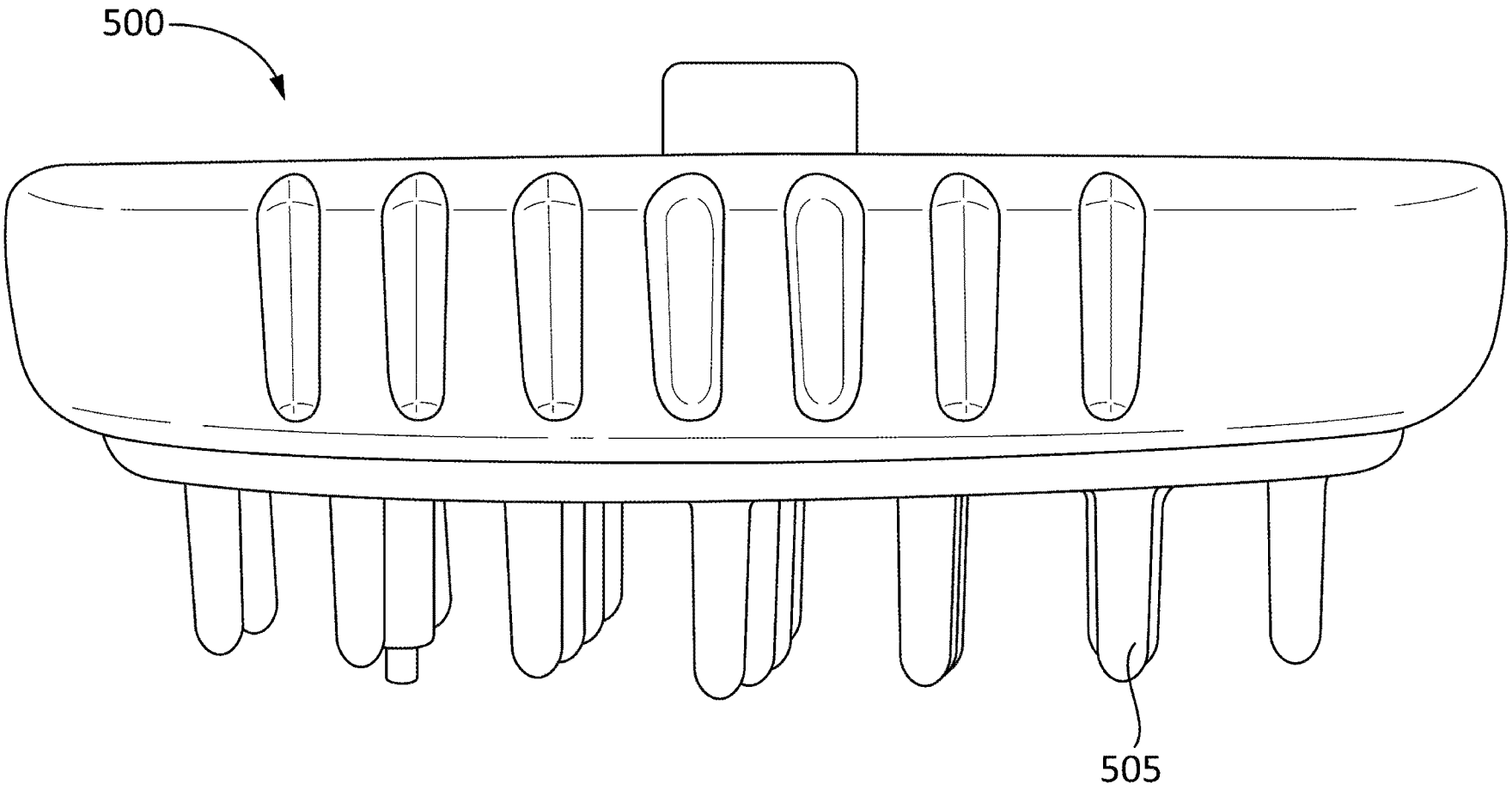
FIG. 5 illustrates an exemplary implementation of a dispensing applicator.

FIG. 5 illustrates an exemplary implementation of a dispensing applicator 500. For example, the dispensing applicator 500 may include dispensing bristles and tapering bristles similar to those described in FIG. 1-4. In this example, the dispensing applicator 500 includes one or more round-tipped bristles 505. In some implementations, the round-tipped bristles 505 may advantageously distribute pressure substantially evenly on an application surface. For example, the application surface may be the scalp of a head. In some examples, the round tips may promote comfort to the scalp during a liquid application process.

Figure 6:
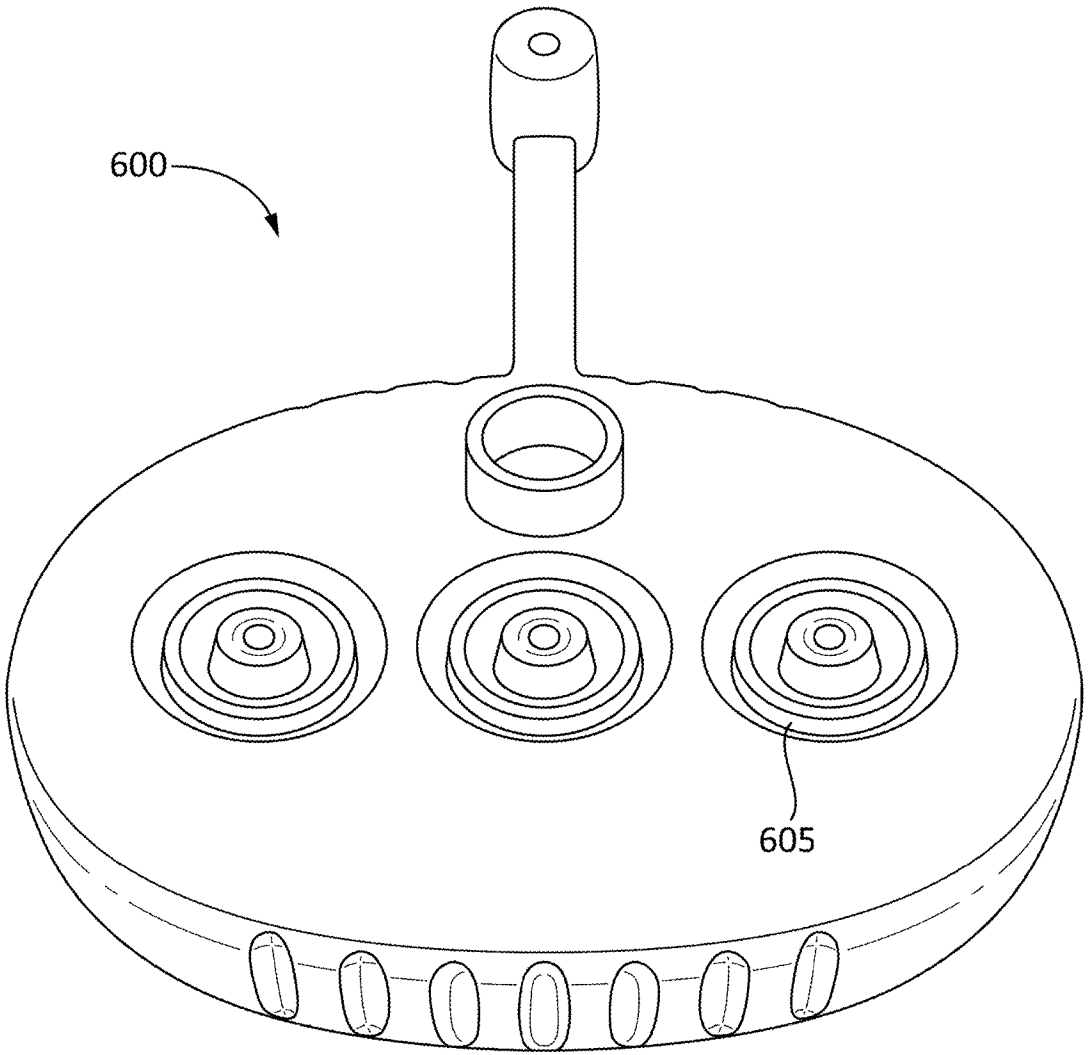
FIG. 6 illustrates another exemplary implementation of a dispensing applicator.

FIG. 6 illustrates another exemplary implementation of a dispensing applicator 600. For example, the dispensing applicator 500 may include dispensing bristles and tapering bristles similar to those described in FIG. 1-4. In this example, the dispensing applicator 600 includes a multi-folded gusset 605. In some examples, the multi-folded gusset 605 may provide substantially greater flexibility than a single-folded gusset. For example, the greater flexibility may allow the dispensing applicator 600 to have a higher maximum rate of dispensing.

In various embodiments, the gusset 605 may have varying slopes at each bellow fold. For example, the resistance of the outer bellows may be substantially higher than the inner bellows. In some implementations, the gusset 605 may include steeper sloped bellows in the inner folds than the outer folds. For example, different constructions of the gusset may advantageously facilitate the control of dispensing liquid from the dispensing applicator 600.

Figure 7:
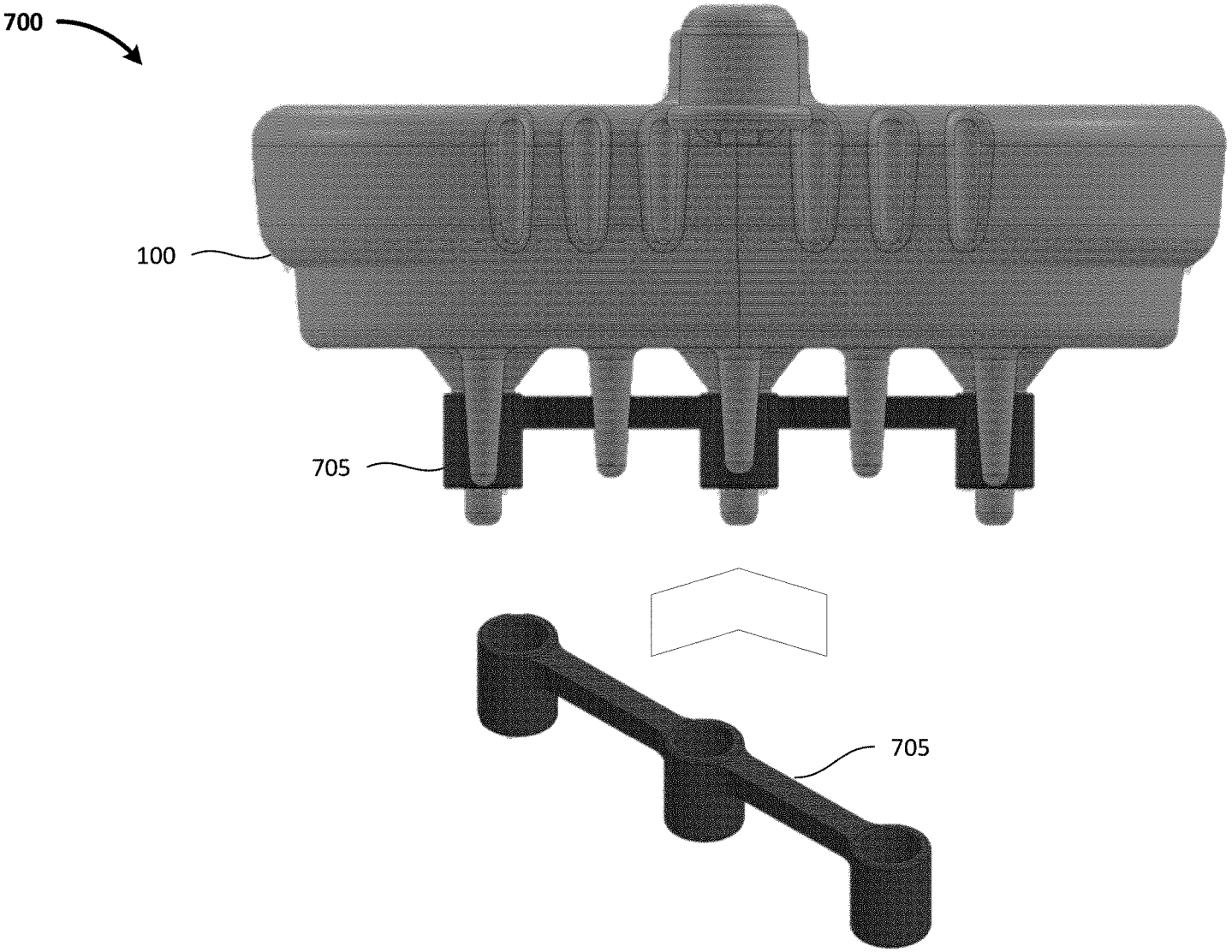
FIG. 7 depicts an exemplary storage closure for an exemplary dispensing applicator.

FIG. 7 depicts an exemplary storage closure for an exemplary dispensing applicator. An assembly 700 includes the dispensing applicator 100 releasably coupled to a closure member 705. As depicted, the closure member 705 includes three cavities corresponding to the dispensing bristles 125. In various embodiments, a closure member may be configured with one or more cavities (e.g., in a linear array, a 2D array, a 3D array) corresponding to one or more dispensing bristles. The closure member 705 may, for example, be assembled over the at least one dispensing bristle 125. Application of a minimum predetermined force urging the closure member 705 over the at least one dispensing bristle 125 may, for example, induce radial compression of the at least one dispensing bristle 125 by the corresponding cavities. Accordingly, the closure member 705 may seal the fluid communication channel 225 against the dispensing bristle 215, for example.

Various embodiments may advantageously act as a 'plug' to prevent leakage from the dispensing bristles during storage. For example, a user may selectively operate the closure member 705 onto the at least one dispensing bristle 125 to place the assembly 700 into a stowage mode. The user may, for example, selectively operate the closure member 705 off of at least one dispensing bristle 125 to place the dispensing applicator 100 into a deployable mode (e.g., ready to dispense).

Various embodiments may advantageously prevent leakage from the dispensing applicator 100 through the at least one dispensing bristle 125 during extended storage (e.g., 1 day, 1 week, 1 month). Various embodiments may, for example, reduce manufacturing cost due to decreased tolerance requirements.

In some embodiments the closure member 705 may, for example, be coupled (e.g., releasably, fixedly) to the dispensing applicator 100 such that the closure member 705 may be selectively operated to place the dispensing applicator 100 in a stowage (e.g., stoppered) mode and a deployable mode.

Although various embodiments have been described with reference to the figures, other embodiments are possible. For example, different materials may be used to make the dispensing applicated described. In some embodiments, the dispensing applicator as described in this application may be made of polymer. In some embodiments, the dispensing applicator as described in this document may be made of polymers. For example, polymers of different hardness may be suitable for making the dispensing applicator.

In some embodiments, the durometer of the material may, for example, be between Shore A10 and Shore A40. In some embodiments, the durometer may, for example, be between Shore A25 and Shore A30. The durometer may, for example, be substantially Shore A25. The durometer may, for example, be substantially Shore A30. Various embodiments in this range may advantageously provide sufficient flexion to allow the dispensing bristles to be displaced without discomfort to the scalp. In some embodiments, using materials in this hardness range may, for example, provide sufficient resistive force to maintain a seal of the opposing tapers when the dispensing brush is not being applied to the scalp.

In some embodiments an external plug feature may be provided. The external plug may, for example, be configured to releasably occlude one or more apertures. An external plug may, for example, be operated into a stopper mode to occlude one or more dispensing bristles. An external plug may, for example, be operated into a stopper mode to occlude at least some portion of a vent. In various embodiments an external plug(s) may, for example, advantageously retain fluid and/or prevent leakage during long term storage (e.g., greater than 1 day, greater than 1 week, greater than 1 month).

Figure 8:
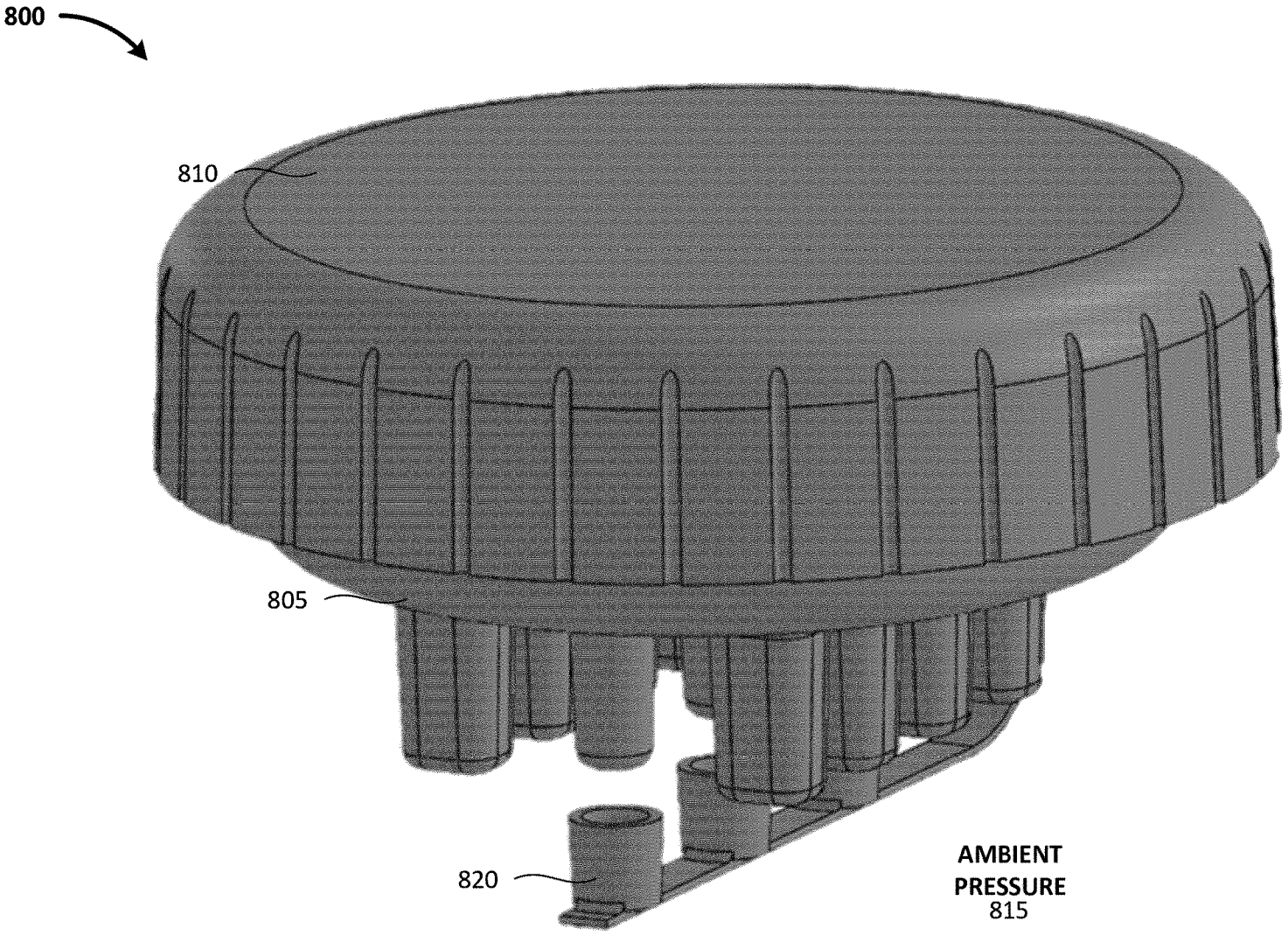
FIG. 8 illustrates another exemplary implementation of a dispensing applicator.

FIG. 8 illustrates another exemplary implementation of a dispensing applicator 800. The exemplary implementation of a dispensing applicator 800 includes a first housing 805. The first housing may couple to a second housing 810. For example, the first housing 805 may sealingly (e.g., fluidly seal, seal against gas exchange) couple to the second housing 810. The coupling of the first housing 805 and the second housing 810 may form a cavity. The cavity may be used to store a fluid. For example, pressure may be applied to a top portion of the second housing 810 to dispense the fluid. The pressure applied to the second housing may cause the pressure within the cavity to be greater than the ambient air pressure 815 outside of the cavity. The distilling bristles may be capped with a cap 820 when the dispensing applicator 800 is in a stowage mode. The pressure differential may cause the fluid to be dispensed from the cavity through the second housing 810. The vacuum pressure from the cavity may allow a user to selectively distribute an amount of a fluid.

Figure 9:
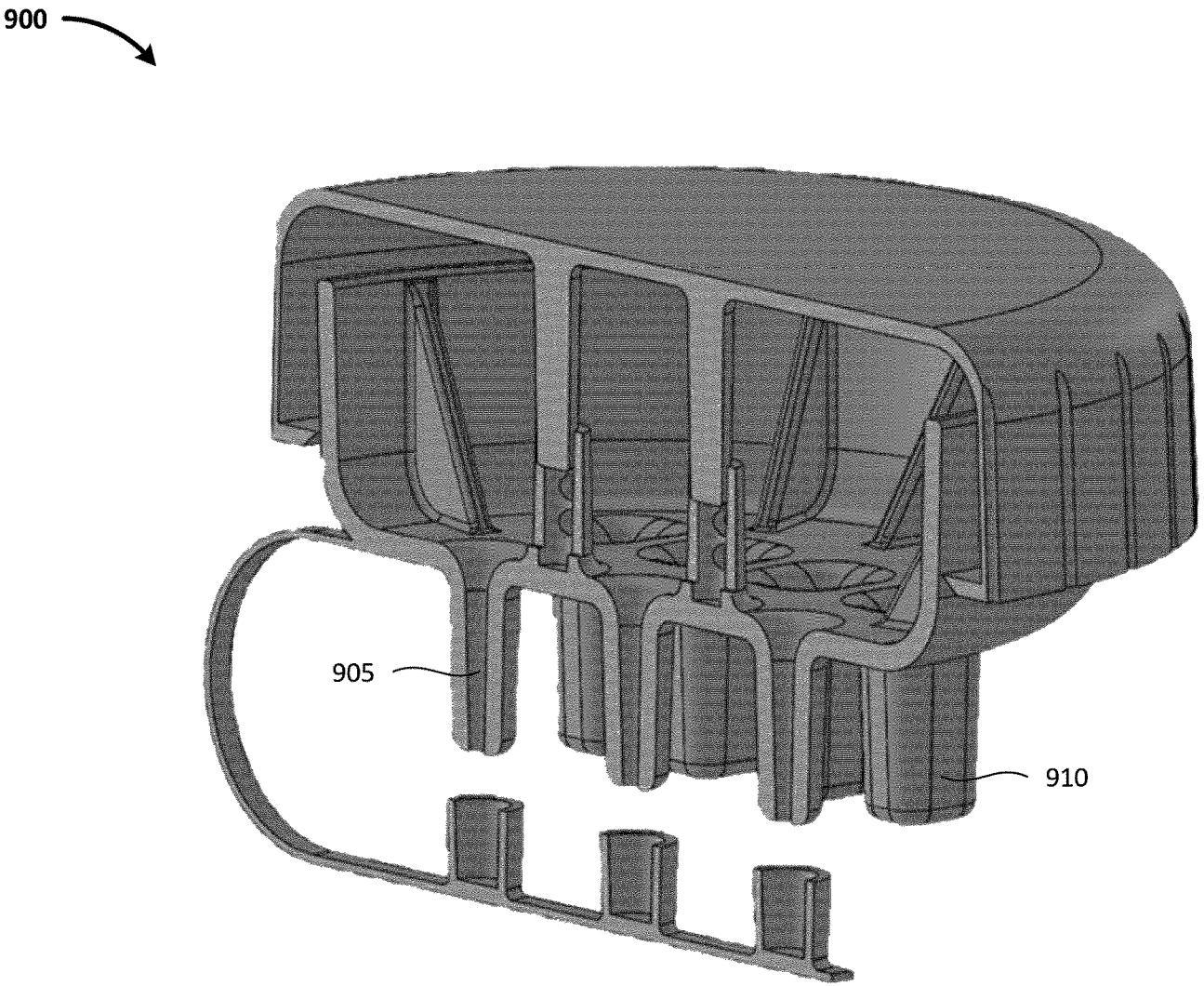
FIG. 9 depicts another cross-section view of an exemplary dispensing applicator.
Figure 10:
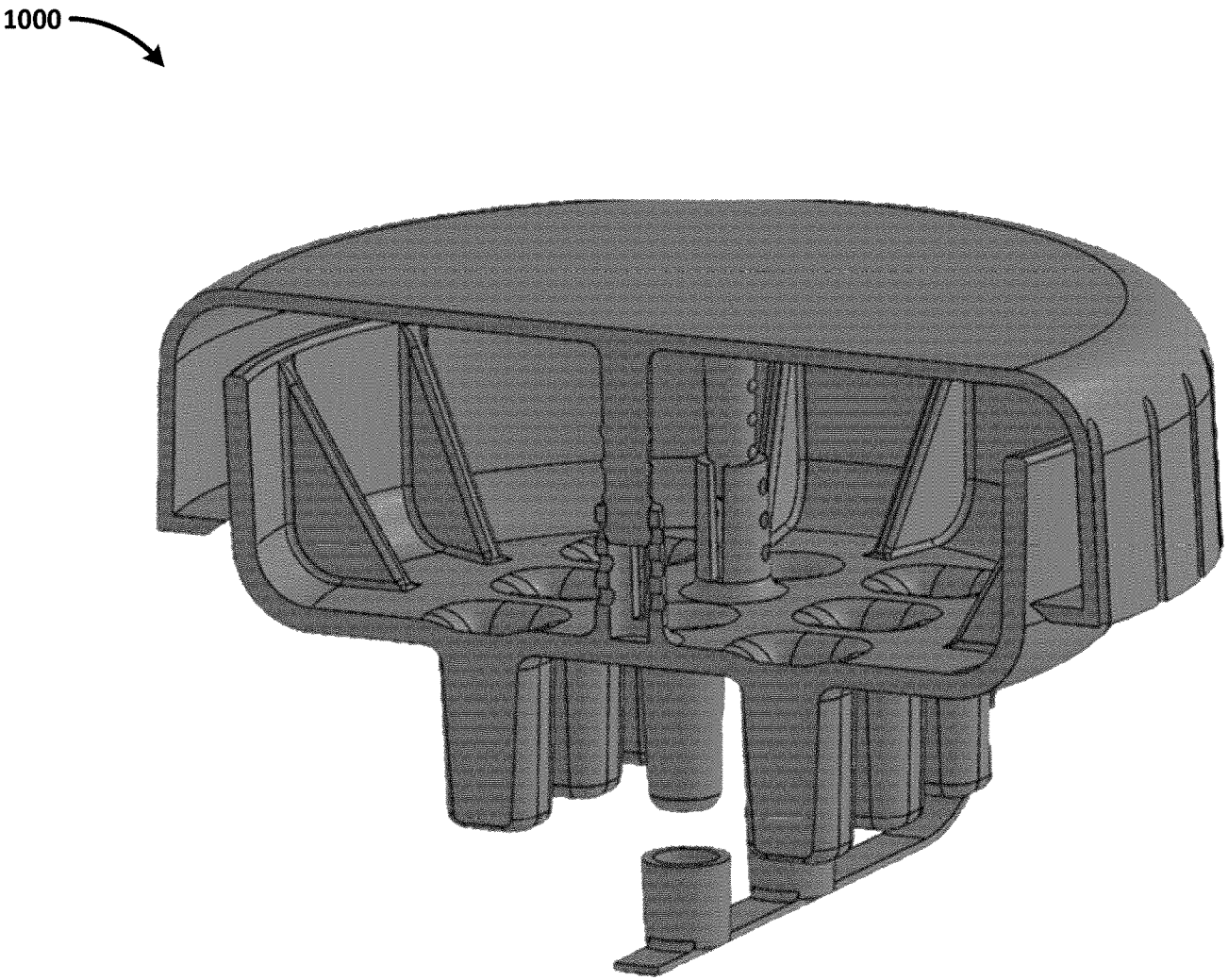
FIG. 10 depicts another cross-sectional view of a dispensing applicator.

FIG. 9 depicts another cross-section view of an exemplary dispensing applicator 900. The exemplary dispensing applicator 900 includes a dispensing bristle 905. The dispensing bristle, for example, may be a hollow bristle. In another embodiment, the exemplary dispensing applicator 900 includes a tapered bristle 910. FIG. 10 depicts another cross-sectional view of a dispensing applicator 1000. As shown in FIGS. 9-10, the exemplary dispensing applicator 900 includes a tactile dispensing guide (TDG).

Figure 11:
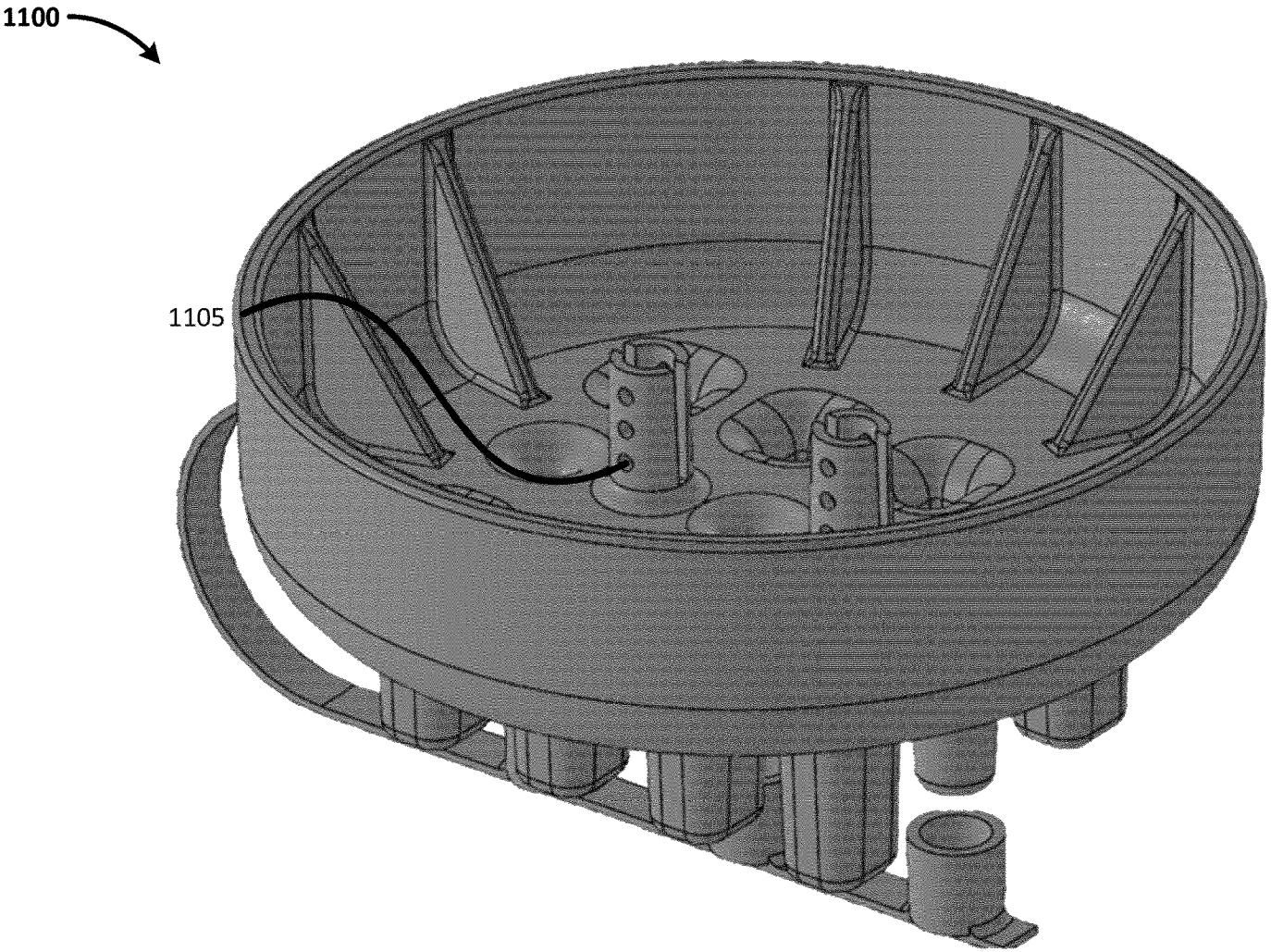
FIG. 11 depicts another exploded view of a first housing of a dispensing applicator.

FIG. 11 depicts another exploded view of a first housing 1100 of a dispensing applicator. In this particular embodiment, the first housing contains a receiver element of the TDG. The receiver element, as depicted, is configured as a cylindrical receiver 1105. In the depicted example, the cylindrical receiver 1105 contains apertures extending from an exterior to an interior of the cylindrical receiver 1105. In some implementations, the apertures may, for example, be configured as pockets or other mating tactile guides. For example, the apertures may be only on one surface of the cylindrical receiver 1105 (e.g., interior, exterior).

Figure 12:
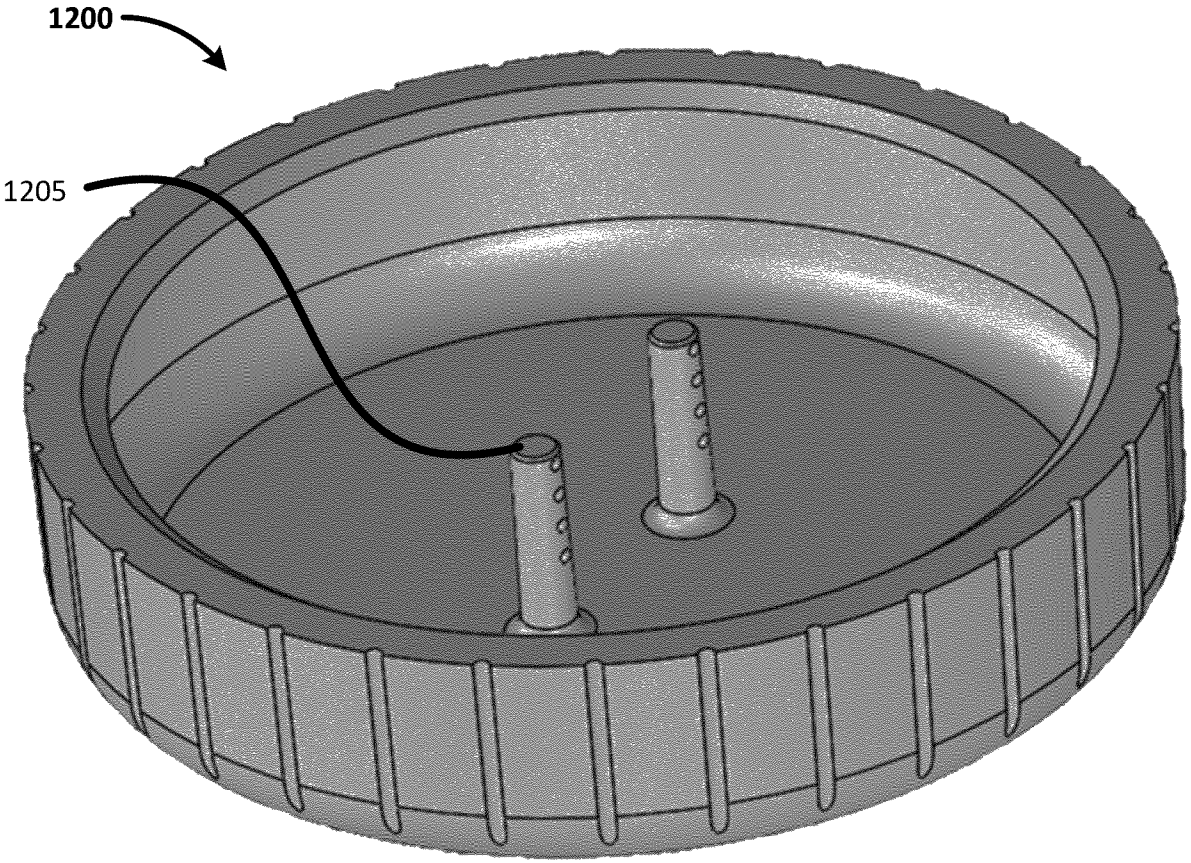
FIG. 12 depicts another exploded view of a second housing of a dispensing applicator.

FIG. 12 depicts another exploded view of a second housing 1200 of a dispensing application. In this particular embodiment, the second housing 1200 includes an insert element of the TDG. In the depicted example, the insert element is configured as a cylindrical insert 1205. The cylindrical insert 1205, as depicted, is provided with protrusions configured to matingly interlock with the apertures in the cylindrical receiver 1105.

The second housing may enclose the cylindrical insert 1205. The cylindrical receiver 1105 may couple with the cylindrical insert 1205. For example, when a force is applied by a user on to a top of the second housing 1200, the cylindrical insert 1205 may insert into the cylindrical receiver 1105 of the first housing 1100.

In some embodiments, for example, as the top of a first housing (e.g., an upper housing such as the second housing 1200) is flexed downwards, the holes in the cylindrical receiver and cylindrical insert may interlock at predetermined locations. Pressing down on the first housing to a predetermined location may dispense a determinable amount of fluid from the dispenser. By way of example and not limitation, the interlockings of the cylindrical receiver and cylindrical insert may be positioned to deliver a predetermined amount of fluid. For example, each 'click' may be configured to dispense 0.01 mL of fluid. Each click may, for example, dispense 0.5 mL of fluid. Each click may, for example, dispense 1 mL of fluid. Each click may, for example, dispense 10 ml of fluid. Each click may, for example, dispense 20 ml of fluid. Each click may, for example, dispense 30 ml of fluid. Other predetermined fluid amounts may be configured such as by controlling, by way of example and not limitation, a cavity size, a displacement: force relationship, a spacing of interlocking elements, or some combination thereof.

The interlocking elements may, for example, be configured to create a noise and/or tactile feedback (e.g., 'snapping' and/or 'clicking' feel) to alert the user of the amount of fluid dispensed. The noise may, for example, include a clicking noise.

Figure 13:
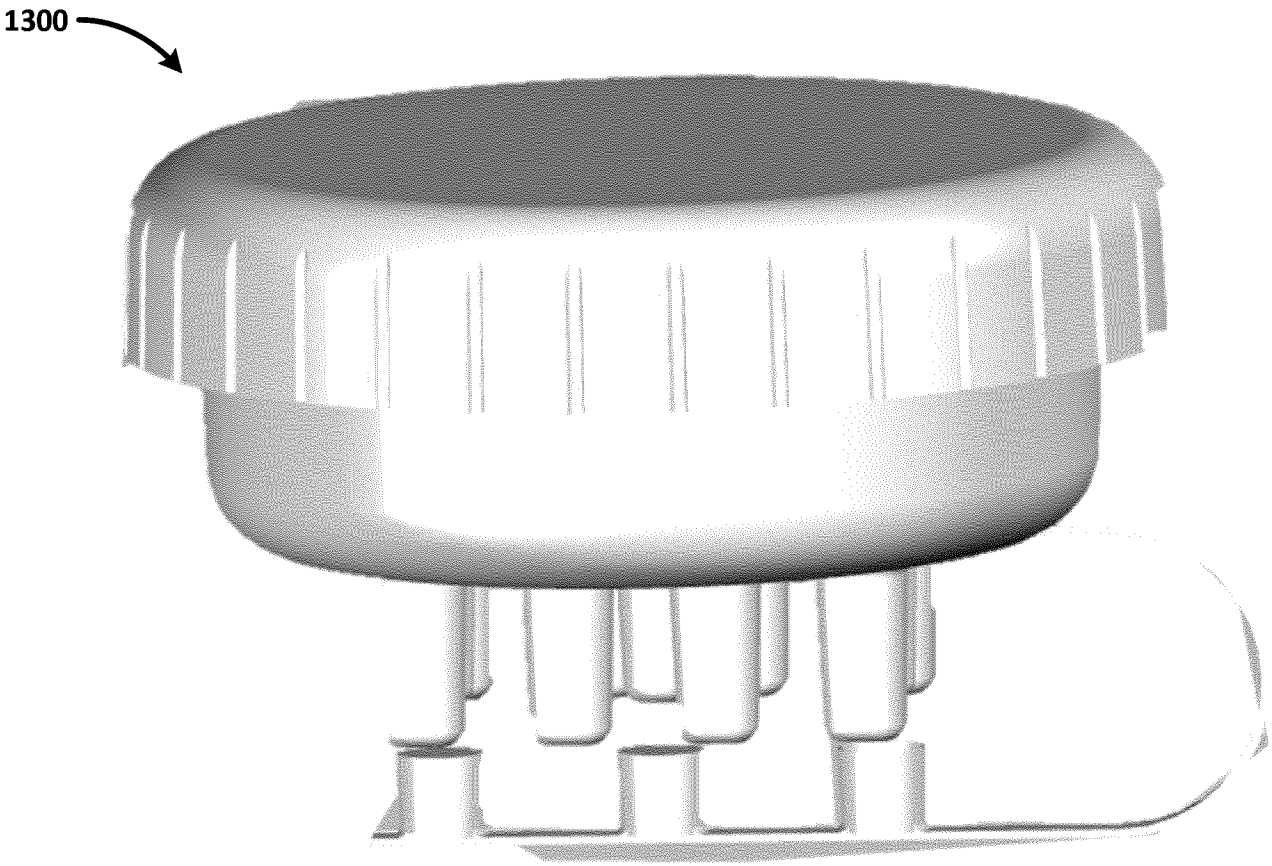
FIG. 13 depicts another exploded view of another exemplary dispensing applicator.
Figure 14:
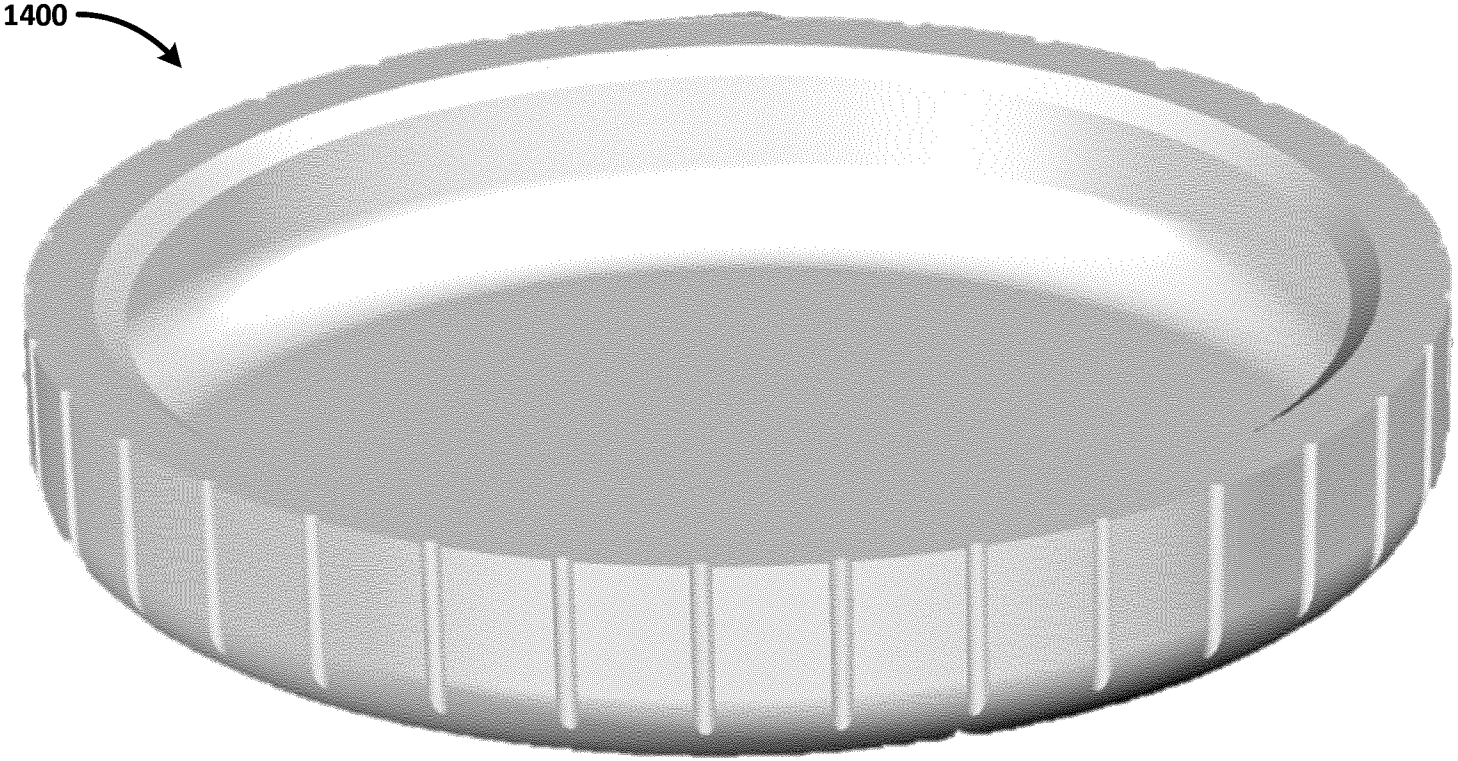
FIG. 14 depicts a first housing included in the exemplary dispensing applicator
Figure 15:
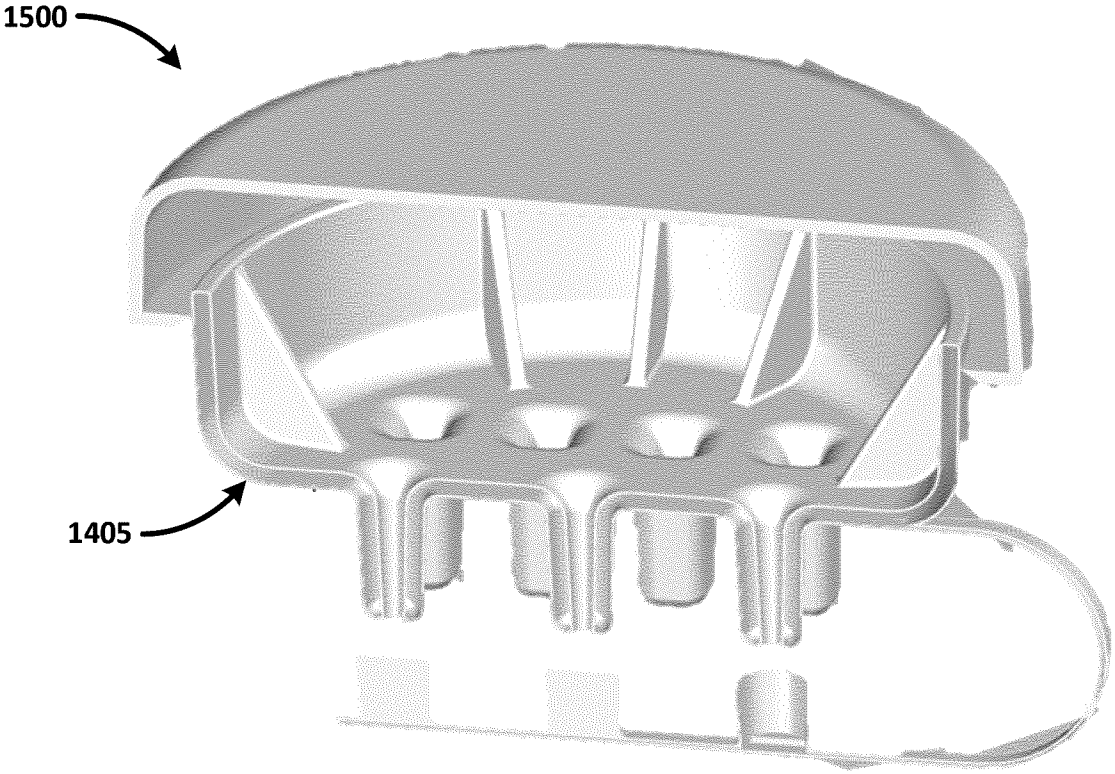
FIG. 15 depicts a cross-sectional view of the exemplary dispensing applicator.

FIG. 13 depicts another exploded view of an exemplary dispensing applicator 1300 without tactile dispensing guides. FIG. 14 depicts a first housing 1400 included in the exemplary dispensing applicator. The first housing 1400, for example, may be a cap. FIG. 15 depicts a cross sectional view 1500 of the exemplary dispensing applicator. The second housing 1405 depicted in the cross-sectional view 1500 of the dispensing applicator 1300 may couple with the first housing 1400. When pressure is applied to the first housing 1400, the second housing may flex downward. The flex downward of the second housing may cause volume within the cavity of the exemplary dispensing applicator 1300 to be displaced and grow smaller. The displacement of volume within the cavity may cause fluid stored within the cavity to be released through exit valves contained in the second housing. The fluid dispersed within the second housing may be dispensed on a user.

Figure 16:
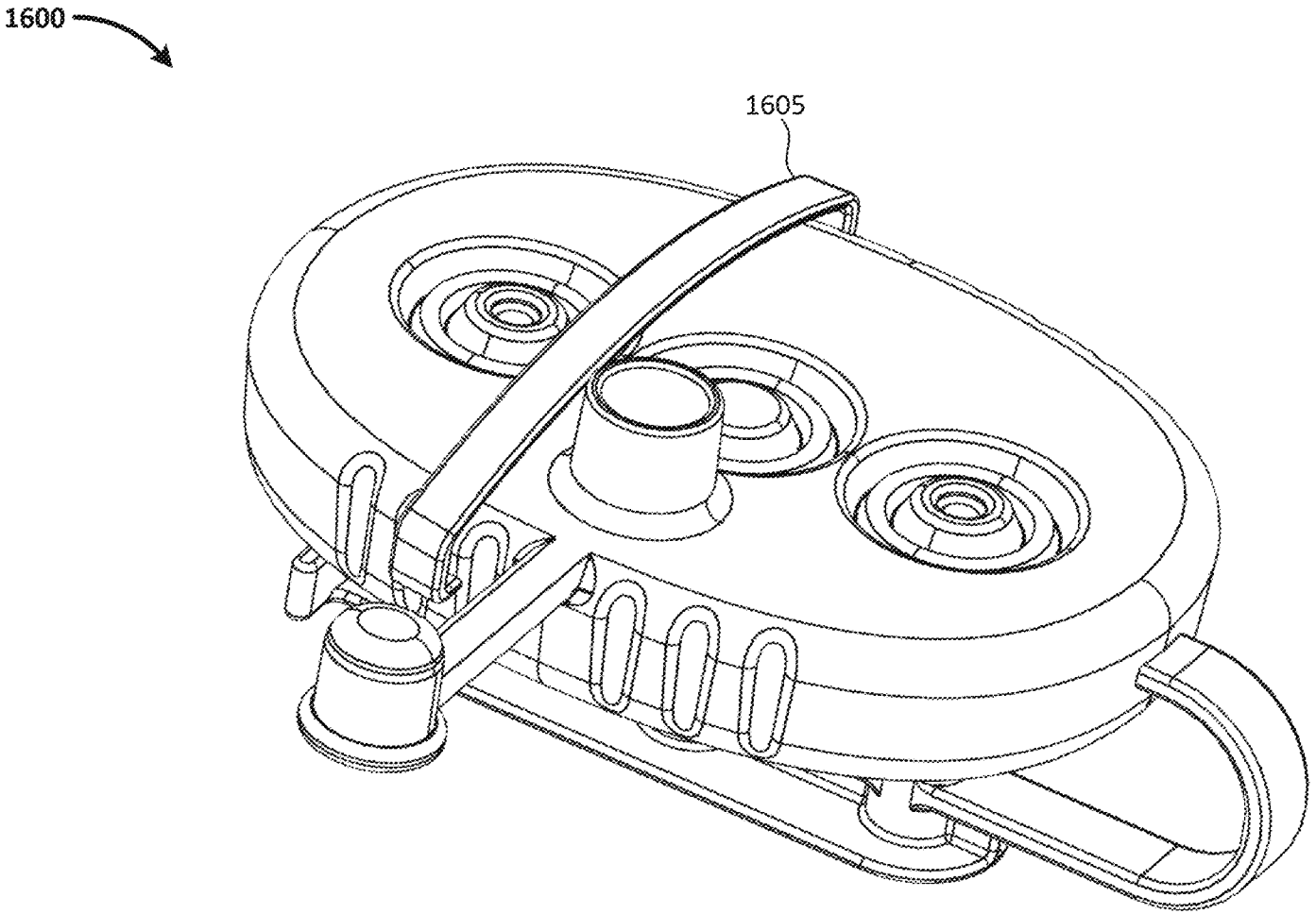
FIG. 16 and FIG. 17 depict an embodiment of a dispensing applicator with a handle.
Figure 17:
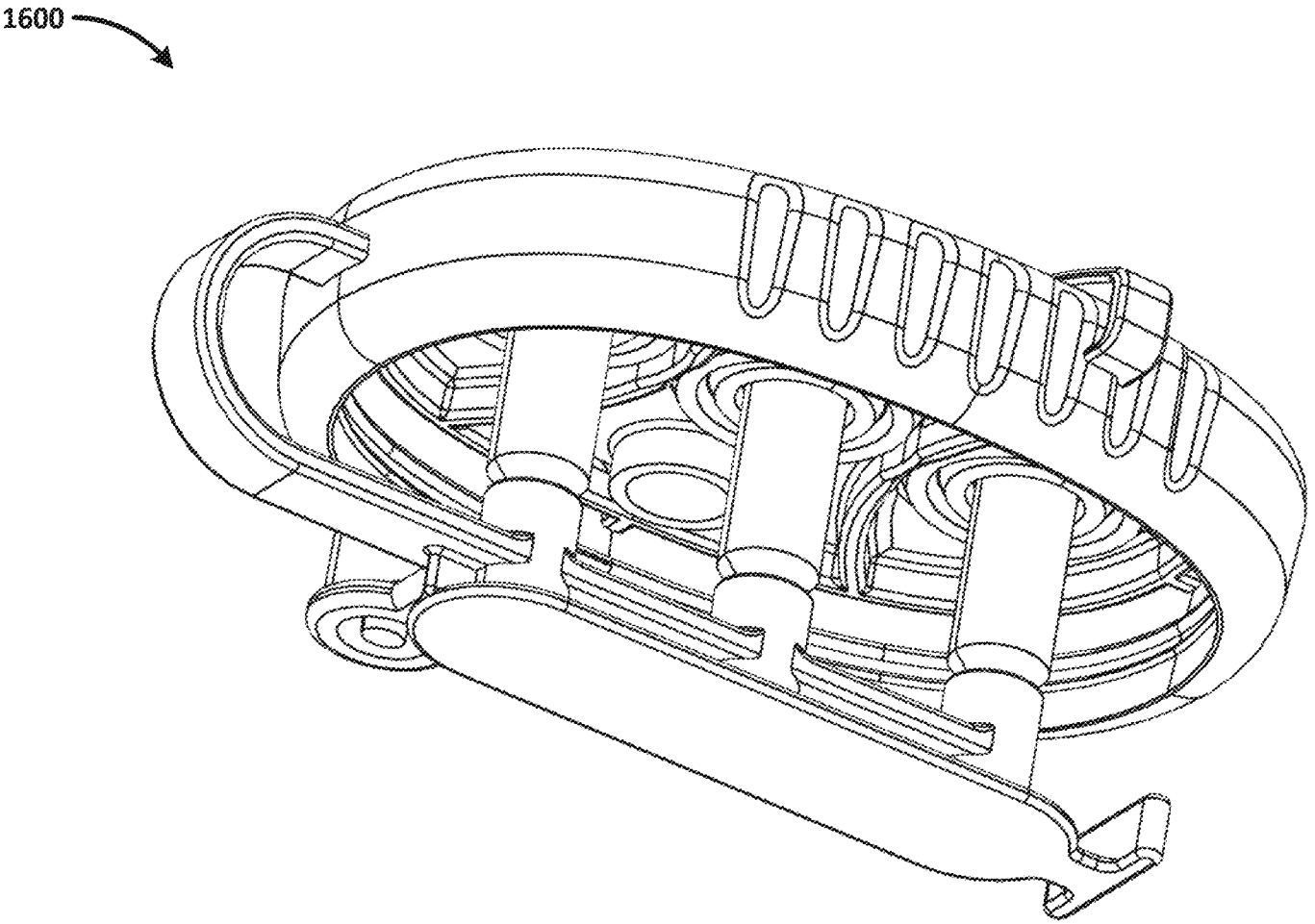

FIG. 16 and FIG. 17 depict an embodiment of a dispensing applicator 1600 with a handle 1605. The dispensing applicator 1600 may, for example, be configured to dispense fluid such as disclosed at least with reference to dispensing applicator 100.

Figure 18:
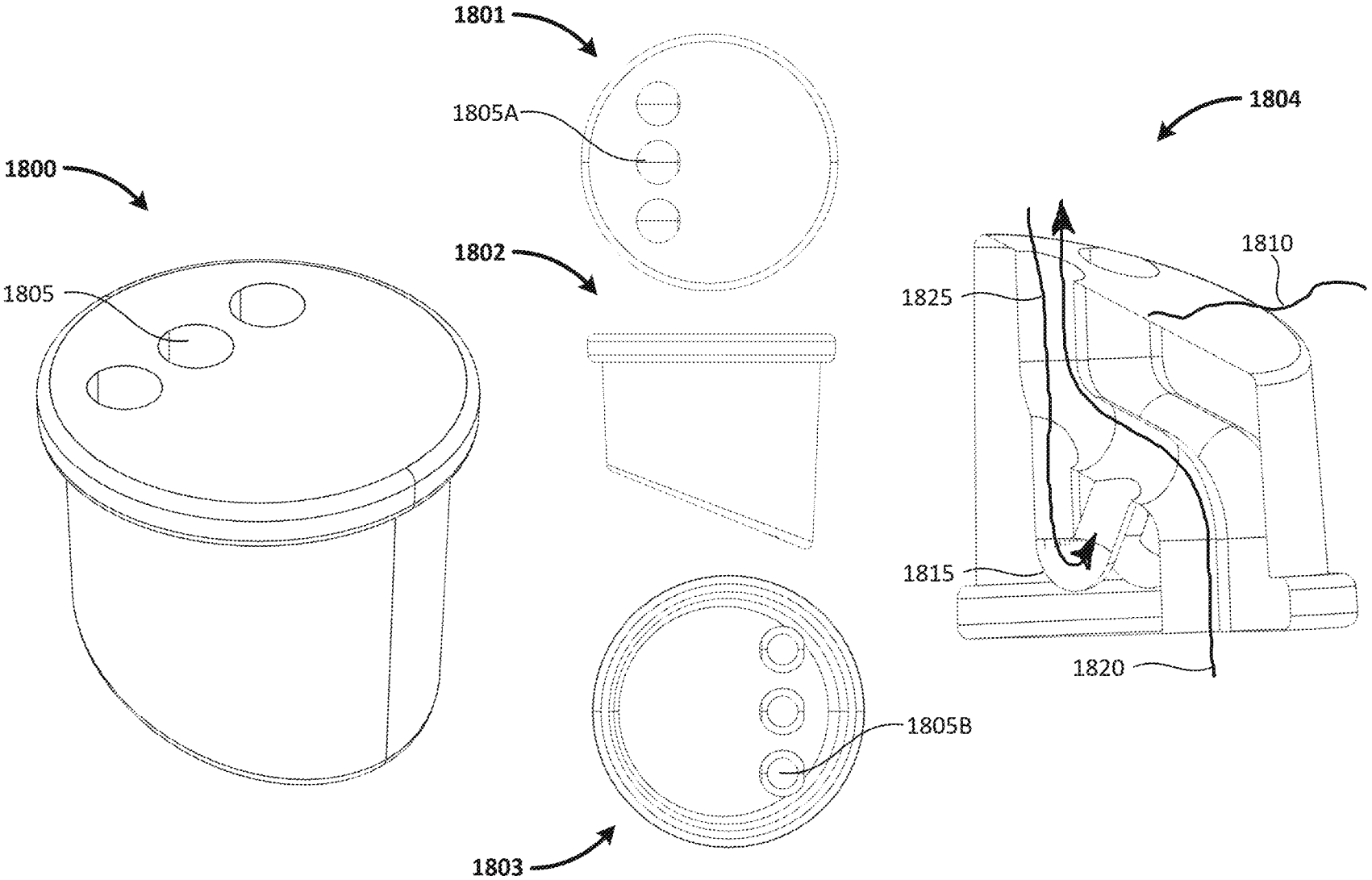
FIG. 18 depicts an exemplary valvular conduit vent.

FIG. 18 depicts an exemplary valvular conduit vent. The exemplary valvular conduit vent may, for example, be used for venting a cavity. In some implementations, by way of example and not limitation, the exemplary valvular conduit vent may be used to replace the vent 450 and/or film 455.

The valvular conduit vent 1800 is depicted in a perspective view. Conduits 1805 are provided through the valvular conduit vent 1800. An outer end 1805A of the conduits 1805 are depicted in a top plan view 1801. A side elevation view 1802 is depicted, the other side being substantially identical. A bottom plan view 1803 is depicted, showing the inner ends 1805B of the conduits 1805. The valvular conduit vent 1800 may, for example, be disposed in an aperture in a housing (e.g., an upper housing such as first housing 105). The valvular conduit vent 1800 may, for example, be integrally formed (e.g., molded from continuous material and/or as a unitary body with) a housing.

As depicted in a bottom perspective view 1804, the valvular conduit vent 1800 may protrude into a cavity of a dispensing applicator. For example, when a dispensing applicator provided with the valvular conduit vent 1800 is turned upside down, fluid 1810 in the cavity may be below the inner ends 1805B of the conduits 1805.

Air may, for example, flow substantially unobstructed through a first path 1820 into the cavity. Fluid sloshed into the inner ends 1805B, for example, may flow into a trap 1815 in the conduits 1805 along a second path 1825. The weight of the fluid as it attempts to exit the trap may provide pressure against further fluid flowing through the trap, thereby resisting flow of fluid out of the outer end 1805A. Accordingly, such embodiments may advantageously resist spillage. Some implementations may, for example, advantageously avoid the need for a replaceable filter and/or membrane. Some implementations may, for example, advantageously reduce assembly costs (e.g., by using a molded one-piece valve). Embodiments with a valvular conduit may, for example, advantageously reduce moving parts.

Although an exemplary system has been described with reference to the figures, other implementations may be deployed in other industrial, scientific, medical, commercial, and/or residential applications.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A dispensing apparatus comprising:

a first housing;

a second housing coupled to the first housing to form a cavity configured to receive a fluid;

a plurality of hollow bristles, each defining a fluid communication channel in fluid communication with the cavity; and, a plurality of dispensing bristles extending out of the cavity through the fluid communication channels in a stowage mode, the plurality of dispensing bristles connected to a common gusset configured to deform in response to a predetermined force such that, when the predetermined force is applied to at least one of the plurality of dispensing bristles, the at least one dispensing bristle is operated into a dispensing mode within at least one corresponding fluid communication channel of the plurality of hollow bristles such that the fluid is dispensed from the cavity through the at least one corresponding fluid communication channel.

2. The apparatus of claim 1, wherein a floor of the cavity is sloped towards an entry into each of the fluid communication channels.

3. The apparatus of claim 1, wherein at least one of the first housing and the second housing comprise a vent configured to resist leakage of the fluid from the cavity through the vent.

4. The apparatus of claim 3, wherein the vent comprises a valvular conduit.

5. The apparatus of claim 1, wherein application of the predetermined force generates a pressure in the cavity urging the fluid through the hollow bristles.

6. The apparatus of claim 5, wherein the plurality of dispensing bristles further comprise a first taper and the fluid communication channels further comprise a second taper such that when a force is applied to at least one of the dispensing bristles that is less than the predetermined force the first taper and second taper are configured to sealing close the fluid communication channel of the at least one dispensing bristle, thereby resisting flow of the fluid out of the cavity.

7. The apparatus of claim 6, wherein the first taper and second taper are configured such that when a force greater than the predetermined force is applied to at least one of the dispensing bristles, the first taper is forced proximally away from the second taper, thereby operating the at least one dispensing bristle into a dispensing mode within at least one corresponding fluid communication channel of the plurality of hollow bristles such that the fluid is dispensed from the cavity through the at least one corresponding fluid communication channel.

8. The apparatus of claim 7, wherein the cavity is fluidly sealed except for the fluid communication channels through the hollow bristles.

9. The apparatus of claim 1, further comprising:

a tactile dispensing guide element (TDGE) coupled to the first housing; and, a mating TDGE coupled to the second housing, wherein the TDGE and the mating TDGE are configured such that an application of the predetermined force onto the first housing operates the TDGE in the first housing to a predetermined interlocking relationship with the mating TDGE in the second housing such tactile feedback is provided that a predetermined amount of fluid has been dispensed from the cavity through the at least one corresponding fluid communication channel.

10. The apparatus of claim 1, wherein each gusset urges a corresponding dispensing bristle of the plurality of dispensing bristles into a stowage mode occluding fluid through the corresponding fluid communication channel.

* * * * *